US009260772B2

(12) United States Patent
Kawata

(10) Patent No.: US 9,260,772 B2
(45) Date of Patent: Feb. 16, 2016

(54) HARD PHASE FORMING ALLOY POWDER, WEAR RESISTANT SINTERED ALLOY, AND PRODUCTION METHOD FOR WEAR RESISTANT SINTERED ALLOY

(71) Applicant: HITACHI POWDERED METALS CO., LTD., Matsudo-shi, Chiba (JP)

(72) Inventor: Hideaki Kawata, Matsudo (JP)

(73) Assignee: HITACHI POWDERED METALS CO., LTD., Matsudo (JP)

( * ) Notice: Subject to any disclaimer, the term of this patent is extended or adjusted under 35 U.S.C. 154(b) by 499 days.

(21) Appl. No.: 13/707,235

(22) Filed: Dec. 6, 2012

(65) Prior Publication Data

US 2013/0091986 A1 Apr. 18, 2013

Related U.S. Application Data

(62) Division of application No. 12/458,063, filed on Jun. 30, 2009, now abandoned.

(30) Foreign Application Priority Data

| | | |
|---|---|---|
| Jul. 3, 2008 | (JP) | 2008-174624 |
| Jul. 3, 2008 | (JP) | 2008-174629 |
| Dec. 22, 2008 | (JP) | 2008-325074 |
| Dec. 22, 2008 | (JP) | 2008-325075 |
| Dec. 22, 2008 | (JP) | 2008-325076 |
| Dec. 22, 2008 | (JP) | 2008-325077 |

(51) Int. Cl.

| | |
|---|---|
| ***C22C 38/52*** | (2006.01) |
| ***C22C 33/02*** | (2006.01) |
| ***C22C 38/02*** | (2006.01) |
| ***C22C 38/44*** | (2006.01) |
| ***C22C 38/46*** | (2006.01) |
| ***C22C 38/48*** | (2006.01) |

(52) U.S. Cl.

CPC ..... *C22C 38/52* (2013.01); *C22C 33/0285* (2013.01); *C22C 38/02* (2013.01); *C22C 38/44* (2013.01); *C22C 38/46* (2013.01); *C22C 38/48* (2013.01); *B22F 2998/10* (2013.01)

(58) Field of Classification Search

CPC ..... C22C 38/52
USPC ..... 78/243; 75/243
See application file for complete search history.

(56) References Cited

U.S. PATENT DOCUMENTS

| | | | | |
|---|---|---|---|---|
| 3,839,024 | A | 10/1974 | Demo et al. | |
| 4,919,719 | A | 4/1990 | Abe et al. | |
| 5,824,922 | A | 10/1998 | Aonuma et al. | |
| 2005/0132842 | A1 | 6/2005 | Kawata et al. | |
| 2005/0181231 | A1 | 8/2005 | Gupta et al. | |
| 2005/0193861 | A1 | 9/2005 | Sato et al. | |
| 2006/0032328 | A1 * | 2/2006 | Chikahata et al. | 75/243 |
| 2006/0086617 | A1 | 4/2006 | Goto et al. | |
| 2007/0081914 | A1 * | 4/2007 | Yoshihiro | C22C 1/051 419/11 |
| 2011/0023808 | A1 | 2/2011 | Sato et al. | |

FOREIGN PATENT DOCUMENTS

| | | | |
|---|---|---|---|
| DE | 38 30 447 | A1 | 3/1989 |
| EP | 1 536 028 | A2 | 6/2005 |
| JP | A-56-152947 | | 11/1981 |
| JP | A-64-15349 | | 1/1989 |
| JP | A-5-43915 | | 2/1993 |
| JP | A-5-43998 | | 2/1993 |
| JP | A-7-90441 | | 4/1995 |
| JP | A-9-195012 | | 7/1997 |
| JP | A-10-46298 | | 2/1998 |
| JP | A-2002-356704 | | 12/2002 |
| JP | A-2005-248234 | | 9/2005 |
| JP | A-2006-52468 | | 2/2006 |
| WO | WO 2009/122985 | A1 | 10/2009 |

OTHER PUBLICATIONS

Notification of Reasons for Rejection dated Mar. 6, 2013 from Japanese Patent Application No. 2008-174624 (with English-language translation).

German Office Action dated Jan. 17, 2012 from German Patent Application No. 11 2009 031 390.7 (with English-language translation).

* cited by examiner

*Primary Examiner* — Jessee Roe
*Assistant Examiner* — Christopher Kessler
(74) *Attorney, Agent, or Firm* — Oliff PLC

(57) ABSTRACT

A hard phase forming alloy powder, for forming a hard phase dispersed in a sintered alloy, consists of, by mass %, 15 to 35% of Mo, 1 to 10% of Si, 10 to 40% of Cr, and the balance of Co and inevitable impurities. A production method, for a wear resistant sintered alloy, includes preparing a matrix forming powder, the hard phase forming alloy powder, and a graphite powder. A wear resistant sintered alloy exhibits a metallic structure in which 15 to 45% of a hard phase is dispersed in a matrix. The hard phase consists of, by mass %, 15 to 35% of Mo, 1 to 10% of Si, 10 to 40% of Cr, and the balance of Co and inevitable impurities.

9 Claims, No Drawings

HARD PHASE FORMING ALLOY POWDER, WEAR RESISTANT SINTERED ALLOY, AND PRODUCTION METHOD FOR WEAR RESISTANT SINTERED ALLOY

This is a Division of application Ser. No. 12/458,063 filed Jun. 30, 2009, which claims the benefit of Japanese Application Nos. 2008-174624 and 2008-174629 each filed Jul. 3, 2008, and claims the benefit of Japanese Application Nos. 2008-325074, 2008-325075, 2008-325076 and 2008-325077, each filed on Dec. 22, 2008. The disclosures of the prior applications are hereby incorporated by reference herein in its entirety.

BACKGROUND OF THE INVENTION

1. Technical Field

The present invention relates to a hard phase forming alloy powder that may preferably be used for forming a hard phase dispersed in a wear resistant sintered alloy. The wear resistant sintered alloy, such as that used in valve sheets for internal-combustion engines, must have wear resistance at high temperatures. The present invention also relates to a production method for a wear resistant sintered alloy using the hard phase forming alloy powder, and the wear resistant sintered alloy may preferably be used for valve sheets for internal-combustion engines. In addition, the present invention relates to a wear resistant sintered alloy obtained by the production method.

2. Background Art

For a sintered alloy, the alloy design can be freely selected, and various characteristics, such as heat resistance and wear resistance, can be easily added thereto compared to doing so for ingot materials. Therefore, the sintered alloy is used for valve sheets for internal-combustion engines. In such wear resistant sintered alloy for valve sheets, a hard phase having a high degree of hardness is generally dispersed in an iron-based alloy matrix primarily to improve wear resistance. For example, the following sintered alloys are known. A sintered alloy, in which ferroalloy particles are dispersed in an iron-based alloy matrix as a hard phase, is disclosed in Japanese Patent Application of Laid-Open No. 64-015349. This sintered alloy is formed by adding a ferroalloy powder, such as ferromolybdenum and ferrotungsten, to a raw powder and then sintering. Another sintered alloy, in which a hard phase is dispersed in an iron-based alloy matrix, is disclosed in Japanese Patent Application of Laid-Open No. 09-195012. This sintered alloy is formed by adding a high-speed tool steel powder or a die steel powder to a raw powder and then sintering, and metal carbides are dispersed in the hard phase. Specifically, when high wear resistance is required for a sintered alloy, it is preferable that a Co-based alloy powder or a Ni-based alloy powder (see Japanese Patent Application of Laid-Open No. 10-046298) be added to a raw powder and be dispersed as a hard phase. For the Co-based alloy powder, a Co—Cr—W alloy (see Japanese Patent Application of Laid-Open No. 64-015349) and a Co—Mo—Si alloy (see Japanese Patent Application of Laid-Open No. 56-152947) may be used.

SUMMARY OF THE INVENTION

The cost of a wear resistant sintered alloy, in which Co—Mo—Si alloy is dispersed as a hard phase, has increased because the costs of Co and Mo have been rising recently. In view of recent environmental issues and crude oil depletion issue, alcohol-based fuels of biological origin (biofuels) are being used more frequently as fuels for internal-combustion engines. The alcohol fuels generate acidic materials during combustion, and therefore, a wear resistant sintered alloy used for valve sheets is required to have higher corrosion resistance. Accordingly, an object of the present invention is to provide a hard phase forming alloy powder at lower cost, and the hard phase forming alloy powder exhibits wear resistance to the same degree or to a greater degree than the degree of wear resistance obtained by using a conventional Co—Mo—Si alloy powder. Moreover, an object of the present invention is to provide a wear resistant sintered alloy at lower cost, and the wear resistant sintered alloy has higher corrosion resistance than the corrosion resistance of a conventional sintered alloy. Furthermore, an object of the present invention is to provide a production method for the wear resistant sintered alloy. In the following description, all of the symbols "%" represent percentages of mass ratio, that is, "mass %".

The present invention provides a hard phase forming alloy powder for forming a hard phase dispersed in a sintered alloy. The hard phase forming alloy powder consists of, by mass %, 15 to 35% of Mo, 1 to 10% of Si, 10 to 40% of Cr (preferably, 20 to 40% of Cr), and the balance of Co and inevitable impurities. In this case, not more than 80 mass % of Co is preferably substituted by Fe, and not more than 5 mass % of Mn is preferably added.

In the hard phase forming alloy powder of the present invention, Cr, which is relatively low cost, is used as a matrix strengthening element. Cr is added to a raw powder of a wear resistant sintered alloy and is sintered, whereby Cr forms a hard phase dispersed in the sintered alloy. In sintering, Cr in the hard phase forming alloy powder strengthens the alloy matrix of the hard phase, and Cr is dispersed from the hard phase forming alloy powder and strengthens the iron-based alloy matrix of the wear resistant sintered alloy. In addition, Cr forms a passive oxide film on the surface of a wear resistant part. Therefore, a wear resistant sintered alloy using the hard phase forming alloy powder of the present invention exhibits superior corrosion resistance and wear resistance.

The present invention provides a production method for a wear resistant sintered alloy, and the production method includes mixing 15 to 45% of the hard phase forming alloy powder and 0.5 to 1.5% of a graphite powder with a matrix forming powder into a raw powder. The production method further includes compacting the raw powder into a green compact having a predetermined shape and includes sintering the green compact.

In the production method for the wear resistant sintered alloy, according to a first aspect of the present invention, the matrix forming powder is preferably made of a mixed powder consisting of 1 to 5 mass % of a nickel powder and the balance of an iron powder. As the iron powder, an ore-reduced iron powder including 0.3 to 1.5 mass % of metal oxides is more preferably used.

In the production method for the wear resistant sintered alloy, according to a second aspect of the present invention, the matrix forming powder is preferably made of an iron alloy powder consisting of 1 to 5 mass % of Cr and the balance of Fe and inevitable impurities. In this case, the iron alloy powder preferably includes at least one of Mo, V, and Nb at not more than 2.4 mass %. In the second aspect of the present invention, the matrix forming powder is more preferably made of a mixed powder consisting of the iron alloy powder and not more than 5 mass % of a nickel powder with respect to the raw powder.

In the production method for the wear resistant sintered alloy, according to a third aspect of the present invention, the matrix forming powder is preferably made of an iron alloy powder consisting of, by mass %, 3 to 8% of Co, 1 to 2% of Ni, 1 to 2% of Mo, and the balance of Fe and inevitable impurities. In the third aspect of the present invention, the matrix forming powder is more preferably made of a mixed powder consisting of the iron alloy powder and not more than 5 mass % of a nickel powder with respect to the raw powder.

In the production method for the wear resistant sintered alloy, according to a fourth aspect of the present invention, the matrix forming powder is preferably made of an iron alloy powder consisting of, by mass %, 1 to 3% of Ni, 0.5 to 2% of Mo, 0.1 to 1% of Cr, 0.1 to 0.5% of Mn, and the balance of Fe and inevitable impurities. In the fourth aspect of the present invention, the matrix forming powder is more preferably made of a mixed powder consisting of the iron alloy powder and not more than 5 mass % of at least one of a nickel powder and a copper powder with respect to the raw powder.

In the production method for the wear resistant sintered alloy, according to a fifth aspect of the present invention, the matrix forming powder is preferably made of an iron alloy powder consisting of 1 to 7 mass % of Mo and the balance of Fe and inevitable impurities. In the fifth aspect of the present invention, the matrix forming powder is more preferably made of a mixed powder consisting of the iron alloy powder and not more than 5 mass % of a nickel powder with respect to the raw powder.

In the production method for the wear resistant sintered alloy of the present invention, at least one kind of powder of a machinability improving material is preferably added to the raw powder at 0.3 to 2 mass %. The powder of the machinability improving material is selected from the group consisting of lead powder, disulfide molybdenum powder, manganese sulfide powder, boron nitride powder, calcium metasilicate mineral powder, and calcium fluoride powder. The wear resistant sintered alloy obtained by sintering has pores, and one selected from the group consisting of lead, lead alloy, copper, copper alloy, and acrylic resin is preferably infiltrated or impregnated into the pores.

The present invention provides a wear resistant sintered alloy having a metallic structure in which 15 to 45% of a hard phase is dispersed in the matrix, and the hard phase consists of 15 to 35% of Mo, 1 to 10% of Si, 10 to 40% of Cr, and the balance of Co and inevitable impurities. In the composition of the hard phase, not more than 80 mass % of Co is preferably substituted by Fe, and not more than 5 mass % of Mn is preferably added.

In the wear resistant sintered alloy, according to a first aspect of the present invention, the overall composition preferably consists of, by mass %, 1 to 5% of Ni, 2.25 to 33.3% of Co, 1.5 to 18% of Cr, 2.25 to 15.75% of Mo, 0.15 to 4.5% of Si, 0.5 to 1.5% of C, and the balance of Fe and inevitable impurities. In this case, the matrix is preferably made of an Fe—Ni—C alloy. In addition, at least one kind of an oxide of a metal is more preferably added in the Fe—Ni—C alloy matrix at 0.15 to 1.25 mass % with respect to the overall composition. The metal is selected from the group consisting of aluminum, silicon, magnesium, iron, titanium, and calcium.

In the wear resistant sintered alloy, according to a second aspect of the present invention, the overall composition preferably consists of, by mass %, 2.34 to 20.73% of Cr, 2.25 to 15.75% of Mo, 0.15 to 4.5% of Si, 2.25 to 33.3% of Co, 0.5 to 1.5% of C, and the balance of Fe and inevitable impurities. In this case, the matrix is preferably made of an Fe—Cr—C alloy. In addition, more preferably, at least one of Mo, V, and Nb is added in the Fe—Cr—C alloy matrix at not more than 2 mass % with respect to the overall composition. Moreover, Ni is more preferably added in the Fe—Cr—C alloy matrix at not more than 5 mass % with respect to the overall composition.

In the wear resistant sintered alloy, according to a third aspect of the present invention, the overall composition preferably consists of, by mass %, 1.5 to 18% of Cr, 0.54 to 1.69% of Ni, 3.09 to 16.84% of Mo, 0.15 to 4.5% of Si, 4.76 to 37.66% of Co, 0.5 to 1.5% of C, and the balance of Fe and inevitable impurities. In this case, the matrix is preferably made of an Fe—Co—C alloy. In addition, Ni is more preferably added in the Fe—Co—C alloy matrix at not more than 5 mass % with respect to the overall composition.

In the wear resistant sintered alloy, according to a fourth aspect of the present invention, the overall composition preferably consists of, by mass %, 1.58 to 18.55% of Cr, 0.54 to 2.54% of Ni, 2.67 to 16.84% of Mo, 0.15 to 4.5% of Si, 2.25 to 33.30% of Co, 0.05 to 0.42% of Mn, 0.5 to 1.5% of C, and the balance of Fe and inevitable impurities. In this case, the matrix is preferably made of an Fe—Ni—Mo—C alloy. In addition, at least one of Ni and Cu is more preferably added in the Fe—Ni—Mo—C alloy matrix at not more than 5.0 mass % with respect to the overall composition.

In the wear resistant sintered alloy, according to a fifth aspect of the present invention, the overall composition preferably consists of, by mass %, 1.5 to 18% of Cr, 3.09 to 19.57% of Mo, 0.15 to 4.5% of Si, 2.25 to 33.3% of Co, 0.5 to 1.5% of C, and the balance of Fe and inevitable impurities. In this case, the matrix is preferably made of an Fe—Mo—C alloy. In addition, Ni is more preferably added in the Fe—Mo—C alloy matrix at not more than 5.0 mass % with respect to the overall composition.

In the wear resistant sintered alloy of the present invention, the sintered alloy has pores and grain boundaries, and 0.3 to 2 mass % of at least one kind of powder of machinability improving material is preferably dispersed in the pores and the grain boundaries. The machinability improving material is selected from the group consisting of lead, disulfide molybdenum, manganese sulfide, boron nitride, calcium metasilicate mineral, and calcium fluoride. In addition, one selected from the group consisting of lead, lead alloy, copper, copper alloy, and acrylic resin is preferably infiltrated or impregnated in the pores of the sintered alloy.

In the hard phase forming alloy powder of the present invention, Cr, which is relatively low cost, is used as a matrix strengthening element. Cr is added to the raw powder of a wear resistant sintered alloy and is sintered, whereby Cr forms a hard phase dispersed in the sintered alloy. In sintering, Cr in the hard phase forming alloy powder strengthens the alloy matrix of the hard phase, and Cr is dispersed from the hard phase forming alloy powder and strengthens the iron based alloy matrix of the wear resistant sintered alloy. In addition, Cr forms a passive oxide film on the surface of a wear resistant part. Therefore, the wear resistant sintered alloy using the hard phase forming alloy powder of the present invention exhibits superior corrosion resistance and wear resistance. Accordingly, the wear resistant sintered alloy of the present invention is preferably used for valve sheets of internal-combustion engines using an alcohol fuel as a fuel.

PREFERRED EMBODIMENTS OF THE INVENTION

1. Hard Phase Forming Alloy Powder

Similar to a conventional Co—Mo—Si alloy powder, the hard phase forming alloy powder of the present invention is added to a raw powder and is sintered, whereby the hard phase forming alloy powder is dispersed in the matrix as a hard phase. The essential feature of the present invention is that a great amount of Cr is added to the conventional Co—Mo—Si alloy powder so as to improve the conventional Co—Mo—Si alloy powder.

Co is included in the hard phase forming alloy powder of the present invention and is solid-solved in the alloy matrix of the hard phase formed by the hard phase forming alloy powder. As a result, Co improves heat resistance of the hard phase and also improves strength and wear resistance at high temperatures. Co included in the hard phase forming alloy powder is dispersed in the matrix of a sintered alloy in sintering, whereby the matrix of the sintered alloy is strengthened by solid solution strengthening, and the hard phase is strongly combined to the matrix of the sintered alloy. In addition, a partial amount of Co combines with Mo, Cr, and Si and forms molybdenum silicides, chromium silicides, and complex silicides thereof. The silicides function as a core of a hard phase and prevent plastic flow and adhesion of the matrix of the sintered alloy, whereby wear resistance is improved.

Mo is included in the hard phase forming alloy powder of the present invention and is dispersed in the matrix of a sintered alloy in sintering. As a result, the matrix of the sintered alloy is strengthened by solid solution strengthening, and quenchability of the matrix of the sintered alloy is improved, whereby strength and wear resistance of the sintered alloy are improved. Mo combines mainly with Si and forms hard molybdenum silicides, and a partial amount of Mo reacts with Cr and Co and forms complex silicides. The silicides function as a core of the hard phase. Therefore, plastic flow and adhesion of the matrix of the sintered alloy are prevented, whereby wear resistance is improved. In this case, when the amount of Mo in the hard phase forming alloy powder is less than 15%, the matrix is not sufficiently strengthened. Moreover, silicides are not sufficiently precipitated, and the above pinning effect is not sufficiently obtained, whereby wear resistance is decreased. On the other hand, when more than 35% of Mo is included in the hard phase forming alloy powder, the hard phase forming alloy powder is hardened, whereby compressibility of the raw powder is decreased. Moreover, since the amount of silicides is increased, a mating part may be easily worn. Therefore, the amount of Mo in the hard phase forming alloy powder is set to be 15 to 35%.

Si combines with Mo, Co, and Cr and forms hard molybdenum silicides, chromium silicides, and complex silicides thereof, thereby improving wear resistance. When the amount of Si in the hard phase forming alloy powder is less than 1%, silicides are not sufficiently precipitated. When the amount of Si in the hard phase forming alloy powder is greater than 10%, the hard phase forming alloy powder is hardened, whereby compressibility and sinterability is decreased. Therefore, the amount of Si in the hard phase forming alloy powder is set to be 1 to 10%.

Cr is solid-solved in the alloy matrix of the hard phase that is formed after sintering, whereby the alloy matrix of the hard phase is strengthened. Moreover, Cr is dispersed in the matrix of a sintered alloy in sintering and strengthens the matrix of the sintered alloy. Cr dispersed in the sintered alloy forms a passive oxide film on the surface of a wear resistant part and improves corrosion resistance and oxidation resistance. A partial amount of Cr combines with Si, Mo, and Co and forms hard chromium silicides and complex silicides. Cr is low in cost compared to the costs of Co and Mo, and Cr is added to decrease the amount of Co, whereby the hard phase forming alloy powder is inexpensive, and a wear resistant sintered alloy can be produced at lower cost. When Cr having the above effects in the hard phase forming alloy powder is less than 10%, the above effects are not sufficiently obtained. In order to efficiently obtain the above effects, the amount of Cr is preferably set to be 20% or more. On the other hand, when the amount of Cr in the hard phase forming alloy powder is greater than 40%, oxide films are strongly formed on the surfaces of the hard phase forming alloy powder particles, whereby sintering may be prevented. Moreover, since the hard phase forming alloy powder is hardened by the oxide films, compressibility of the raw powder is decreased, and strength and wear resistance of the sintered alloy are decreased. Therefore, the amount of Cr in the hard phase forming alloy powder is set to be 10 to 40%, preferably, 20 to 40%.

In the present invention, by setting the amount of Cr in the hard phase forming alloy powder for forming a hard phase as described above, corrosion resistance and oxidation resistance are improved. Therefore, a partial amount of Co for forming the alloy matrix of the hard phase can be substituted by Fe. That is, since Cr solid-solved in Fe forms a passive oxide film and thereby improves corrosion resistance and oxidation resistance, Fe, which is inexpensive, can be substituted part of the amount of Co that has superior corrosion resistance but is expensive. In this case, not more than 80% of Co in the hard phase forming alloy powder can be substituted by Fe.

In the present invention, by adding Mn in the hard phase forming alloy powder, Mn is solid-solved in the alloy matrix of the hard phase formed after sintering, and the alloy matrix of the hard phase is strengthened. By strengthening the alloy matrix of the hard phase in this manner, flow and drop off of silicides (molybdenum silicides, chromium silicides, and complex silicides thereof) precipitated in the hard phase are prevented, whereby superior wear resistance is obtained under severe conditions. Mn is dispersed in Fe matrix of the sintered alloy and increases fixability of the hard phase, whereby drop off of the hard phase is prevented, and wear resistance is improved. When the amount of such Mn in the hard phase forming alloy powder is greater than 5%, Mn oxide films are formed on the surface layers of the hard phase forming alloy powder particles, whereby dispersion during sintering is prevented, and the fixability of the hard phase is decreased. Therefore, the upper limit of the amount of Mn in the hard phase forming alloy powder is set to be 5%.

For the matrix of the wear resistant sintered alloy, in which the hard phase made from the hard phase forming alloy powder of the present invention is dispersed, a conventional wear resistant sintered alloy matrix may be used, and specifically, a low-alloy steel or a stainless steel may be used. That is, in a raw powder of a sintered alloy to which a conventional Co—Mo—Si based hard phase forming alloy powder is added, instead of using the conventional Co—Mo—Si based hard phase forming alloy powder, the hard phase forming alloy powder of the present invention can be used. When such a raw powder is compacted and is sintered, a sintered alloy is obtained. This sintered alloy has corrosion resistance, oxidation resistance, and wear resistance to the same degree or to degrees greater than those of a wear resistant sintered alloy in which a hard phase made from a conventional Co—Mo—Si based hard phase forming alloy powder is dispersed. In addition, since the amount of Co that is expensive is decreased, the sintered alloy can be produced at lower cost.

2. Production Method for Wear Resistant Sintered Alloy and Wear Resistant Sintered Alloy

2-1. Basic Formation

In the present invention, Cr is dispersed in the matrix and forms a passive oxide film by using the above hard phase, and corrosion resistance of the matrix is improved. Therefore, the matrix can be made of an iron alloy, which is relatively inexpensive, without using large amounts of Co and Mo, which are expensive. Specifically, a wear resistant sintered alloy is obtained by the following method. The above hard phase forming alloy powder and a graphite powder are mixed with an iron based matrix forming powder into a raw powder. Then, the raw powder is compacted into a green compact having a predetermined shape, and the green compact is sintered.

When the hard phase forming alloy powder is added to the raw powder at less than 15%, wear resistance is not sufficiently obtained. The hard phase forming alloy powder of the present invention is made by increasing the amount of Cr in a conventional Co—Mo—Si based hard phase forming alloy powder. Since Cr is solid-solved in the Co-alloy matrix, the hardness of the hard phase forming alloy powder is increased, and compressibility thereof is decreased. Therefore, when the hard phase forming alloy powder is added to the raw powder at more than 45%, the compressibility of the raw powder is greatly decreased. Accordingly, the hard phase forming alloy powder is added to the raw powder at 15 to 45%.

The hard phase dispersed in the matrix of the wear resistant sintered alloy is formed by adding the hard phase forming alloy powder and a graphite powder to the iron based matrix forming powder and by sintering. Since the hard phase forming alloy powder is added to the raw powder at 15 to 45%, the amount of the hard phase dispersed in the matrix of the wear resistant sintered alloy is 15 to 45%. As described above, the hard phase forming alloy powder consists of 15 to 35% of Mo, 1 to 10% of Si, 10 to 40% of Cr, and the balance of Co and inevitable impurities. Therefore, in the overall composition of the wear resistant sintered alloy, the amount of Co is 2.25 to 33.3%, the amount of Cr is 1.5 to 18%, the amount of Mo is 2.25 to 15.75%, and the amount of Si is 0.15 to 4.5%. When Mn is added to the hard phase forming alloy powder, the amount of Mn in the overall composition is not more than 2.25%.

A graphite powder is added as a source of C. C is dispersed in the iron based matrix forming powder in sintering and is solid-solved in the Fe matrix, whereby the Fe matrix is strengthened. Moreover, C is added in order to form a matrix structure made of martensite or bainite, which have high strength. When the amount of C is less than 0.5%, the above effects are not sufficiently obtained. On the other hand, when the amount of C is greater than 1.5%, brittle cementite may be precipitated at grain boundaries, whereby strength and wear resistance of the wear resistant sintered alloy are decreased. Therefore, the amount of C in the overall composition is set to be 0.5 to 1.5%. If such C is added and is solid-solved in the iron powder, the hardness of the iron powder is increased, and the compressibility is greatly decreased. Therefore, the entire amount of C is added in the form of a graphite powder. Accordingly, a graphite powder is added to the matrix forming powder at 0.5 to 1.5%.

In the production method for the wear resistant sintered alloy of the present invention, the raw powder is compacted into a green compact having a predetermined shape, and the green compact is sintered. The compacting and the sintering may be performed in the same manner as those for a conventional wear resistant sintered alloy using a Co—Mo—Si alloy powder as a hard phase forming alloy powder. That is, the compacting may be performed at a compacting pressure of 600 to 1000 MPa, and the sintering may be performed at a sintering temperature of 1000 to 1300° C.

A sintered alloy obtained by the above production method exhibits a metallic structure in which 15 to 45% of a hard phase is dispersed in a matrix, and the hard phase consists of 15 to 35% of Mo, 1 to 10% of Si, 10 to 40% of Cr, and the balance of Co and inevitable impurities.

In the wear resistant sintered alloy of the present invention, a machinability improving technique that is conventionally performed may be used. That is, at least one kind of machinability improving material may be added to the raw powder at 0.3 to 2% so as to disperse the machinability improving material in the pores and grain boundaries of the wear resistant sintered alloy. The machinability improving material is selected from the group consisting of lead powder, disulfide molybdenum powder, manganese sulfide powder, boron nitride powder, calcium metasilicate mineral powder, and calcium fluoride powder. These materials are machinability improving components, and the materials function as a starting point for breaking during machining when the materials are dispersed in the matrix, whereby the machinability of the sintered alloy is improved. When the amount of the machinability improving components is less than 0.3%, the effects are not sufficiently obtained. On the other hand, when the amount of the machinability improving components is greater than 2%, the strength of the sintered alloy is decreased.

One selected from the group consisting of lead, lead alloy, copper, copper alloy, and acrylic resin may be infiltrated or impregnated in the pores of the wear resistant sintered alloy of the present invention. When a sintered alloy having pores is machined, the machining is intermittently performed, and impact is intermittently applied to an edge of a tool. However, by adding lead, copper, and the like in the pores, the machining may be continuously performed, and the degree of impact at an edge of a tool is decreased. Lead and lead alloy function as a solid lubricant. Copper and copper alloy have high thermal conductivity, thereby preventing thermal accumulation and decreasing thermal damages at the edge. Acrylic resin functions as a starting point for breaking in machining.

2-2. Fe—Ni—C Alloy Matrix

In the above wear resistant sintered alloy, according to the first preferred embodiment of the present invention, the matrix of the wear resistant sintered alloy is made of an Fe—Ni—C alloy. The Fe—Ni—C alloy does not include Co and Mo, which are expensive, whereby a wear resistant sintered alloy may be formed at lower cost.

Ni is solid-solved in the Fe matrix and thereby strengthens the Fe matrix, and Ni is added in order to easily obtain martensite at a cooling rate after sintering. Ni having such effects is dispersed in Fe at relatively high rate during sintering. Moreover, if Ni is added in the form of an Fe—Ni alloy powder in which Ni is solid-solved in Fe, the main raw powder is hardened. Therefore, Ni is added by adding a nickel powder to the iron powder. In this case, when the nickel powder is added to the iron powder at less than 1%, the above effects are not sufficiently obtained. On the other hand, when the nickel powder is added to the iron powder at more than 5%, a large amount of Ni-rich austenite having low wear resistance is formed and remains. Therefore, the nickel powder is added to the iron powder at 1 to 5%.

C is solid-solved in the Fe matrix and thereby strengthens the Fe matrix, and C is added in order to form a matrix structure made of martensite or bainite, which have high strength. When the amount of C is less than 0.5%, the above effects are not sufficiently obtained. On the other hand, when the amount of C is greater than 1.5%, brittle cementite may be precipitated at grain boundaries, whereby strength and wear resistance of the wear resistant sintered alloy are decreased. Therefore, the amount of C in the overall composition is set to be 0.5 to 1.5%. If such C is added and is solid-solved in the iron powder, the hardness of the iron powder is increased, and the compressibility is greatly decreased. Accordingly, the entire amount of C is added in the form of a graphite powder.

As described above, according to the first embodiment of the present invention, the production method for the wear resistant sintered alloy includes preparing an iron powder, a nickel powder, a hard phase forming alloy powder, and a graphite powder. The hard phase forming alloy powder consists of, by mass %, 15 to 35% of Mo, 1 to 10% of Si, 10 to 40% of Cr, and the balance of Co and inevitable impurities. The production method further includes mixing 1 to 5% of the nickel powder, 15 to 45% of the hard phase forming alloy powder, and 0.5 to 1.5% of the graphite powder with the iron powder into a raw powder. The production method further includes compacting the raw powder into a green compact having a predetermined shape and includes sintering the green compact.

As described above, according to the first embodiment of the present invention, the wear resistant sintered alloy consists of, by mass %, 1 to 5% of Ni, 2.25 to 33.3% of Co, 1.5 to 18% of Cr, 2.25 to 15.75% of Mo, 0.15 to 4.5% of Si, 0.5 to 1.5% of C, and the balance of Fe and inevitable impurities. The wear resistant sintered alloy exhibits a metallic structure in which 15 to 45% of a hard phase is dispersed in an Fe—Ni—C alloy matrix, and the hard phase consists of 15 to 35% of Mo, 1 to 10% of Si, 10 to 40% of Cr, and the balance of Co and inevitable impurities.

The matrix of the wear resistant sintered alloy of the present invention is made of an Fe—Ni—C alloy by adding a nickel powder and a graphite powder to the iron powder, as described above. In this case, as the iron powder of the main raw material, an ore-reduced iron powder is preferably used. The ore-reduced iron powder includes a very small amount of metallic oxides, such as aluminum, silicon, magnesium, iron, titanium, and calcium, due to the production method thereof. These metallic oxides are dispersed in the matrix as fine metallic oxide phases, and these metallic oxides function as free-machining components and improve machinability. In contrast, an atomized iron powder and a mill scale-reduced iron powder, which are generally used, do not include sufficient amount of metallic oxides, and the above effect for improving machinability is not obtained therefrom. In order to obtain the effect for improving the machinability, at least one kind of metallic oxides is required at 0.3% or more, and the metallic oxide is selected from the group consisting of aluminum, silicon, magnesium, iron, titanium, and calcium. On the other hand, when the amount of the metallic oxides in the ore-reduced iron powder is greater than 1.5%, the matrix is embrittled, and the compressibility of the iron powder is decreased. Therefore, the amount of the metallic oxides in the ore-reduced iron powder is set to be 0.3 to 1.5%. This amount of the metallic oxides corresponds to 0.15 to 1.25% with respect to the overall composition.

2-3. Fe—Cr—C Alloy Matrix

In the above wear resistant sintered alloy, according to the second preferred embodiment of the present invention, the matrix of the wear resistant sintered alloy is made of an Fe—Cr—C alloy. The Fe—Cr—C alloy does not include Co and Mo, which are expensive, whereby a wear resistant sintered alloy may be formed at lower cost. By preliminarily adding Cr to the matrix, corrosion resistance of the matrix is further improved. Since Cr is dispersed from the above hard phase to the matrix, the amount of Cr in the Fe—Cr—C alloy matrix can be small compared to the amount of Cr in the hard phase.

Cr included in the matrix forms a passive oxide film and thereby improves the corrosion resistance of the matrix, and Cr is solid-solved in the Fe matrix and strengthens the Fe matrix. Moreover, Cr included in the matrix improves the quenchability of the matrix and forms a matrix structure made of a bainite structure having high strength and high toughness at a cooling rate after sintering. In order to uniformly add such effects of Cr to the entirety of the matrix, Cr is alloyed with Fe and is added in the form of the iron alloy powder. In this case, when the amount of Cr in the iron alloy powder is less than 1%, the above effects are not sufficiently obtained. On the other hand, when the amount of Cr in the iron alloy powder is greater than 5%, the hardness of the iron alloy powder is increased, and the compressibility of the raw powder is decreased. Therefore, the amount of Cr in the iron alloy powder is set to be 1 to 5%.

C is solid-solved in the Fe matrix and thereby strengthens the Fe matrix, and C is added in order to form a matrix structure made of martensite or bainite having high strength. When the amount of C is less than 0.5%, the above effects are not sufficiently obtained. On the other hand, when the amount of C is greater than 1.5%, C combines with Cr and precipitates Cr carbides in the matrix. Cr was added to form a passive oxide film and to improve the corrosion resistance of the matrix. As a result, the concentration of Cr in the matrix is decreased, and the corrosion resistance of the matrix is decreased. Therefore, the amount of C in the overall composition is set to be 0.5 to 1.5%. If such C is added and is solid-solved in the above iron alloy powder, the hardness of the iron alloy powder is increased, and the compressibility of the raw powder is greatly decreased. Accordingly, the entire amount of C is added in the form of a graphite powder.

As described above, according to the second embodiment of the present invention, the production method for the wear resistant sintered alloy includes preparing an iron alloy powder, a hard phase forming alloy powder, and a graphite powder. The iron alloy powder consists of, by mass %, 1 to 5% of Cr and the balance of Fe and inevitable impurities. The hard phase forming alloy powder consists of, by mass %, 15 to 35% of Mo, 1 to 10% of Si, 10 to 40% of Cr, and the balance of Co and inevitable impurities. The production method further includes mixing 15 to 45% of the hard phase forming alloy powder and 0.5 to 1.5% of the graphite powder with the iron alloy powder into a raw powder. The production method further includes compacting the raw powder into a green compact having a predetermined shape and includes sintering the green compact.

As described above, according to the second embodiment of the present invention, the wear resistant sintered alloy consists of, by mass %, 2.34 to 20.73% of Cr, 2.25 to 15.75% of Mo, 0.15 to 4.5% of Si, 2.25 to 33.3% of Co, 0.5 to 1.5% of C, and the balance of Fe and inevitable impurities. The wear resistant sintered alloy exhibits a metallic structure in which 15 to 45% of a hard phase is dispersed in an Fe—Cr—C alloy matrix, and the hard phase consists of 15 to 35% of Mo, 1 to 10% of Si, 10 to 40% of Cr, and the balance of Co and inevitable impurities.

Mo, V, and Nb have higher carbide-forming ability than that of Cr. Therefore, in the wear resistant sintered alloy having the above Fe—Cr—C alloy matrix of the present invention, by adding at least one of Mo, V, and Nb to the Fe—Cr—C alloy matrix, Mo, V, and Nb selectively combine with the above C and form fine metallic carbides dispersed in the matrix. Accordingly, corrosion resistance is not decreased by the precipitation of Cr carbides. In addition, mechanical strength and wear resistance of the matrix can be improved. In order to uniformly add these effects to the entirety of the matrix, at least one of Mo, V, and Nb is preferably added and is solid-solved in the iron alloy powder. In this case, when more than 2.4% of Mo, V, and Nb are added to the iron alloy powder, the hardness of the iron alloy powder is increased, and the compressibility of the raw powder is decreased. Therefore, the total amount of Mo, V, and Nb added to the iron alloy powder is set to be not more than 2.4%. This total amount of Mo, V, and Nb corresponds to not more than 2 mass % with respect to the overall composition.

Ni is solid-solved in the Fe matrix and thereby strengthens the Fe matrix, and Ni improves the quenchability of the matrix. Therefore, in a case of improving wear resistance and mechanical strength by forming a matrix structure made of a martensite structure or a mixed structure of a martensite structure and a bainite structure, instead of forming a matrix structure made of a bainite structure, Ni is added. Ni having such effects is dispersed into Fe at relatively high rate in sintering. Moreover, if Ni is added and is solid-solved in the above iron alloy powder, the iron alloy powder is hardened, and the compressibility of the main raw powder is decreased. Therefore, Ni is added by adding a nickel powder to the iron alloy powder. In this case, when the nickel powder is added to the raw powder at more than 5%, a large amount of Ni-rich austenite having low wear resistance is formed and remains in the matrix. Therefore, the upper limit of the amount of the nickel powder added to the raw powder is set to be 5%.

2-4. Fe—Co—C Alloy Matrix

In the above wear resistant sintered alloy, according to the third embodiment of the present invention, the matrix of the wear resistant sintered alloy is made of an Fe—Co—C alloy. The Fe—Co—C alloy includes Co and Mo, but the amounts of Co and Mo are small, whereby a wear resistant sintered alloy can be formed at lower cost than the cost of a conventional wear resistant sintered alloy.

Co is solid-solved in the Fe matrix and thereby strengthens the Fe matrix, and Co increases the heat resistance of the matrix and improves the wear resistance at high temperatures. In order to uniformly add such effects of Co to the entirety of the matrix, Co is alloyed with Fe and is added in the form of an iron alloy powder. In this case, when the amount of Co in the iron alloy powder is less than 3%, the above effects are not sufficiently obtained. On the other hand, when the amount of Co in the iron alloy powder is greater than 8%, the hardness of the iron alloy powder is increased, the compressibility of the raw powder is decreased, and the cost of the iron alloy powder is high. Therefore, the amount of Co in the iron alloy powder is set to be 3 to 8%.

Mo is solid-solved in the Fe matrix and thereby strengthens the Fe matrix, and Mo increases the quenchability of the matrix and improves the strength and wear resistance of the matrix. In order to uniformly add such effects of Mo to the entirety of the matrix, Mo is added by solid solving Mo in the above iron alloy powder. In this case, when the amount of Mo in the iron alloy powder is less than 1%, the above effects are not sufficiently obtained. On the other hand, when the amount of Mo in the iron alloy powder is greater than 2%, the above improving effects are not efficiently obtained, and the hardness of the iron alloy powder is increased, thereby decreasing the compressibility of the raw powder. Therefore, the amount of Mo in the iron alloy powder is set to be 1 to 2%.

Ni is solid-solved in the Fe matrix and thereby strengthens the Fe matrix, and Ni increases the quenchability of the matrix and improves the strength and wear resistance of the matrix. In order to uniformly add such effects of Ni to the entirety of the matrix, Ni is added by solid solving Ni in the above iron alloy powder. In this case, when the amount of Ni in the iron alloy powder is less than 1%, the above effects are not sufficiently obtained. On the other hand, when the amount of Ni in the iron alloy powder is greater than 2%, the hardness of the iron alloy powder is increased, and the compressibility of the raw powder is decreased. Therefore, the amount of Ni in the iron alloy powder is set to be 1 to 2%.

C is solid-solved in the Fe matrix and strengthens the Fe matrix, and C is added in order to form a matrix structure made of martensite or bainite having high strength. When the amount of C is less than 0.5%, the above effects are not sufficiently obtained. On the other hand, when the amount of C is greater than 1.5%, C combines with Cr and precipitates Cr carbides in the matrix. Cr was added for forming a passive oxide film and improving corrosion resistance of the matrix. As a result, the concentration of Cr in the matrix is decreased, and the corrosion resistance of the matrix is decreased. Therefore, the amount of C in the overall composition is set to be 0.5 to 1.5%. If such C is added and is solid-solved in the above iron alloy powder, the hardness of the iron alloy powder is increased, and the compressibility of the raw powder is greatly decreased. Accordingly, the entire amount of C is added in the form of a graphite powder.

As described above, according to the third embodiment of the present invention, the production method of the wear resistant sintered alloy includes preparing an iron alloy powder, a hard phase forming alloy powder, and a graphite powder. The iron alloy powder consists of, by mass %, 3 to 8% of Co, 1 to 2% of Ni, 1 to 2% of Mo, and the balance of Fe and inevitable impurities. The hard phase forming alloy powder consists of, by mass %, 15 to 35% of Mo, 1 to 10% of Si, 10 to 40% of Cr, and the balance of Co and inevitable impurities. The production method further includes mixing 15 to 45% of the hard phase forming alloy powder and 0.5 to 1.5% of the graphite powder with the iron alloy powder into a raw powder. The production method further includes compacting the raw powder into a green compact having a predetermined shape and includes sintering the green compact.

As described above, according to the third embodiment of the present invention, the wear resistant sintered alloy consists of, by mass %, 1.5 to 18% of Cr, 0.54 to 1.69% of Ni, 3.09 to 16.84% of Mo, 0.15 to 4.5% of Si, 4.76 to 37.66% of Co, 0.5 to 1.5% of C, and the balance of Fe and inevitable impurities. The wear resistant sintered alloy exhibits a metallic structure in which 15 to 45% of a hard phase is dispersed in an Fe—Co—C alloy matrix, and the hard phase consists of 15 to 35% of Mo, 1 to 10% of Si, 10 to 40% of Cr, and the balance of Co and inevitable impurities.

In the wear resistant sintered alloy according to the third embodiment of the present invention, if a greater amount of the above effects of Ni is required, Ni may be added to the raw powder in the form of a nickel powder. Since Ni is dispersed into Fe at relatively high rate in sintering, Ni is preferably added by alloying. Nevertheless, when a larger amount of Ni is added, Ni may be added in the form of a nickel powder, because the effects of Ni are easily added to the entirety of the matrix compared to the cases of other elements. In this case, when the nickel powder is added to the raw powder at greater than 5%, a large amount of Ni-rich austenite having low wear resistance is formed and remains in the matrix. Therefore, the upper limit of the amount of the nickel powder added to the raw powder is set to be 5%.

2-5. Fe—Ni—Mo—C Alloy Matrix

In the wear resistant sintered alloy, according to the fourth preferred embodiment of the present invention, the matrix of the wear resistant sintered alloy is made of an Fe—Ni—Mo—C alloy. The Fe—Ni—Mo—C alloy includes Mo, but the amount of Mo is small, and the Fe—Ni—Mo—C alloy does not include Co. Therefore, a wear resistant sintered alloy can be formed at lower cost than the cost of a conventional wear resistant sintered alloy.

In view of wear resistance, wearing characteristics with respect to a mating material, and strength of a wear resistant sintered alloy, the metallic structure of the matrix is made so as to be bainite. In order to form a matrix structure made of bainite, addition of alloying elements such as Mo, Ni, and Cr is effective. In order to uniformly add this effect to the entirety of the matrix structure, these alloying components are alloyed with Fe and are added in the form of an iron alloy powder. Specifically, the composition of the iron alloy powder is selected so as to consist of, by mass %, 1 to 3% of Ni, 0.5 to 2% of Mo, 0.1 to 1% of Cr, 0.1 to 0.5% of Mn, and the balance of Fe and inevitable impurities. That is, when the amount of Ni is less than 1%, the amount of Mo is less than 0.5%, the amount of Cr is less than 0.1%, and the amount of Mn is less than 0.1%, the matrix is not sufficiently bainitized. On the other hand, when the amount of Ni is greater than 3%, the amount of Mo is greater than 2%, the amount of Cr is greater than 1%, and the amount of Mn is greater than 0.5%, the hardness of the alloy powder is increased, and the compressibility is decreased, whereby strength and wear resistance are decreased.

C is solid-solved in the Fe matrix and thereby strengthens the Fe matrix, and C is added in order to form a matrix structure made of martensite or bainite having high strength. When the amount of C is less than 0.5%, the above effects are not sufficiently obtained. On the other hand, when the amount of C is greater than 1.5%, C combines with Cr and precipitates Cr carbides in the matrix. Cr was added for forming a passive oxide film and improving corrosion resistance of the matrix. As a result, the concentration of Cr in the matrix is decreased, and the corrosion resistance of the matrix is decreased. Therefore, the amount of C in the overall composition is set to be 0.5 to 1.5%. If such C is added and is solid-solved in the above iron alloy powder, the hardness of the iron alloy powder is increased, and the compressibility of the raw powder is greatly decreased. Accordingly, the entire amount of C is added in the form of a graphite powder.

As described above, according to the fourth embodiment of the present invention, the production method of the wear resistant sintered alloy includes preparing an iron alloy powder, a hard phase forming alloy powder, and a graphite powder. The iron alloy powder consists of, by mass %, 1 to 3% of Ni, 0.5 to 2% of Mo, 0.1 to 1% of Cr, 0.1 to 0.5% of Mn, and the balance of Fe and inevitable impurities. The hard phase forming alloy powder consists of, by mass %, 15 to 35% of Mo, 1 to 10% of Si, 10 to 40% of Cr, and the balance of Co and inevitable impurities. The production method further includes mixing 15 to 45% of the hard phase forming alloy powder and 0.5 to 1.5% of the graphite powder with the iron alloy powder into a raw powder. The production method further includes compacting the raw powder into a green compact having a predetermined shape and includes sintering the green compact.

As described above, according to the fourth embodiment of the present invention, the wear resistant sintered alloy consists of, by mass %, 1.58 to 18.55% of Cr, 0.54 to 2.54% of Ni, 2.67 to 16.84% of Mo, 0.15 to 4.5% of Si, 2.25 to 33.30% of Co, 0.05 to 0.42% of Mn, 0.5 to 1.5% of C, and the balance of Fe and inevitable impurities. The wear resistant sintered alloy exhibits a metallic structure in which 15 to 45% of a hard phase is dispersed in an Fe—Ni—Mo—C alloy matrix, and the hard phase consists of 15 to 35% of Mo, 1 to 10% of Si, 10 to 40% of Cr, and the balance of Co and inevitable impurities.

In the wear resistant sintered alloy according to the fourth embodiment of the present invention, when further improvement of the wear resistance is required, a nickel powder or a copper powder may be added to the raw powder so as to form a matrix structure which partially includes martensite with high strength and is made of a mixed structure of bainite and martensite. Ni and Cu have great effects for improving the quenchability, and a nickel powder and a copper powder have low hardness. Therefore, by adding a nickel powder or a copper powder to the above iron alloy powder, a mixed structure of bainite and martensite is easily formed as a matrix structure. In this case, when the amount of the nickel powder added to the iron alloy powder is greater than 5%, a large amount of Ni-rich austenite having low ear resistance is formed and remains in the matrix. In addition, when the amount of the copper powder added to the iron alloy powder is greater than 5%, a soft copper phase is precipitated in the matrix, whereby the strength of the matrix is decreased. Therefore, the upper limit of the amount of the nickel powder added to the iron alloy powder is set to be 5%, and the upper limit of the copper powder added to the iron alloy powder is set to be 5%.

2-6. Fe—Mo—C Alloy Matrix

In the wear resistant sintered alloy, according to the fifth preferred embodiment of the present invention, the matrix of the wear resistant sintered alloy is made of an Fe—Mo—C alloy. The Fe—Mo—C alloy includes Mo, but the amount of Mo is small, and the Fe—Ni—Mo—C alloy does not include Co. Therefore, a wear resistant sintered alloy can be formed at lower cost than the cost of a conventional wear resistant sintered alloy.

Mo is solid-solved in the Fe matrix and thereby strengthens the Fe matrix, and Mo extends the bainite area of an alloy, whereby Mo forms a matrix structure made of a bainite structure having high strength and high toughness at a cooling rate after sintering. In order to uniformly add such effects of Mo in the entirety of the matrix, Mo is alloyed with Fe and is added in the form of an iron alloy powder. In this case, when the amount of Mo in the iron alloy powder is less than 1%, the above effects are not sufficiently obtained. On the other hand, when the amount of Mo in the iron alloy powder is greater than 7%, the hardness of the iron alloy powder is increased, and the compressibility of the raw powder is decreased. Therefore, the amount of Mo in the iron alloy powder is set to be 1 to 7%.

C is solid-solved in the Fe matrix and thereby strengthens the Fe matrix, and C is added in order to form a matrix structure made of martensite or bainite having high strength. When the amount of C is less than 0.5%, the above effects are not sufficiently obtained. On the other hand, when the amount of C is greater than 1.5%, brittle cementite may be precipitated at grain boundaries, whereby strength and wear resistance of the wear resistant sintered alloy are decreased. Therefore, the amount of C in the overall composition is set to be 0.5 to 1.5%. If such C is added and is solid-solved in the iron powder, the hardness of the iron powder is increased, and the compressibility is greatly decreased. Accordingly, the entire amount of C is added in the form of a graphite powder.

As described above, according to the fifth embodiment of the present invention, the production method for the wear resistant sintered alloy includes preparing an iron alloy powder, a hard phase forming alloy powder, and a graphite powder. The iron alloy powder consists of, by mass %, 1 to 7% of Mo and the balance of Fe and inevitable impurities. The hard phase forming alloy powder consists of, by mass %, 15 to 35% of Mo, 1 to 10% of Si, 10 to 40% of Cr, and the balance of Co and inevitable impurities. The production method further includes mixing 15 to 45% of the hard phase forming alloy powder and 0.5 to 1.5% of the graphite powder with the iron alloy powder into a raw powder. The production method further includes compacting the raw powder into a green compact having a predetermined shape and includes sintering the green compact.

As described above, according to the fifth embodiment of the present invention, the wear resistant sintered alloy consists of, by mass %, 1.5 to 18% of Cr, 3.09 to 19.57% of Mo, 0.15 to 4.5% of Si, 2.25 to 33.3% of Co, 0.5 to 1.5% of C, and the balance of Fe and inevitable impurities. The wear resistant sintered alloy exhibits a metallic structure in which 15 to 45% of a hard phase is dispersed in an Fe—Mo—C alloy matrix, and the hard phase consists of 15 to 35% of Mo, 1 to 10% of Si, 10 to 40% of Cr, and the balance of Co and inevitable impurities.

When Ni is solid-solved in an Fe matrix, Ni strengthens the Fe matrix and improves the quenchability of the matrix. In the wear resistant sintered alloy according to the fifth embodiment of the present invention, in a case of improving wear resistance and mechanical strength by forming a matrix structure made of a martensite structure or a mixed structure of a martensite structure and a bainite structure, instead of forming a matrix structure made of a bainite structure, Ni is added. Ni having such effects is dispersed into Fe at relatively high rate in sintering. In addition, if Ni is added and is solid-solved in the above iron alloy powder, the iron alloy powder is hardened, and the compressibility of the main raw powder is decreased. Therefore, Ni is added by adding a nickel powder to the iron alloy powder. In this case, when the nickel powder is added to the raw powder at more than 5%, a large amount of Ni-rich austenite having low wear resistance is formed and remains in the matrix. Therefore, the upper limit of the amount of the nickel powder added to the raw powder is set to be 5%.

EXAMPLES

Example A

Hard Phase Forming Alloy Powder

Example A-1

An iron powder, a copper powder, a graphite powder, and a hard phase forming alloy powder having a composition shown in Table A-1 were prepared. The iron powder, 1.5% of the copper powder, 35% of the hard phase forming alloy powder, and 1% of the graphite powder were added and mixed with a forming lubricant (0.8% of zinc stearate), and a raw powder was obtained. The obtained raw powder was compacted at a compacting pressure of 650 MPa so as to be formed in a ring shape with an outer diameter of 30 mm, an inner diameter of 20 mm, and a height of 10 mm. Next, these green compacts were sintered at 1160° C. for 60 minutes in a decomposed ammonia gas atmosphere, and samples Nos. A01 to A07 were formed. Simple wear tests and corrosion tests were performed on these samples. The results of these tests are shown in Table A-1.

The simple wear tests were performed with the input of colliding and sliding under high temperature. Specifically, the above-described ring-shaped samples (sintered alloys) were formed in a valve sheet in which the inner edge part has a tapered surface of 45°. The valve sheets were pressed into and were fitted into a housing made of an aluminum alloy. Then, discoid mating materials (valves) in which the outer edge partially has a tapered surface of 45° were made from SUH-36. The mating material was moved up and down by rotation of an eccentric cam driven by a motor so that the tapered surface of the sintered alloy and the mating material collided repeatedly. That is, the movement of the valve is a piston movement up and down, and the valve repeats an action of leaving from the valve sheet by rotation of the eccentric cam driven by the motor and an action of colliding with the valve sheet by a valve spring. In these tests, the mating materials were heated with a burner so that the sintered alloys reached 350° C. The colliding frequency was 2800 times per minute, and the repeating time was 10 hours. After these tests were performed, the wear amounts of the valve sheets and wear amounts of the valves were measured and evaluated. In corrosion tests, ring-shaped samples were immersed in a 10% nitric acid solution for one hour, and weight changes were measured before and after the immersing. The weight changes were divided by the surface area, and these calculated values were evaluated as a corrosion loss (mg/cm$^2$).

TABLE A-1

| Sample | Compositions of hard phase forming alloy powder mass % | | | | | Substitutional ratio | Wear amount μm | | | Corrosion loss | |
|---|---|---|---|---|---|---|---|---|---|---|---|
| No. | Co | Fe | Cr | Mo | Si | of Fe | Valve sheet | Valve | Total | mg/cm$^2$ | Notes |
| A01 | Balance | — | 8.0 | 28.0 | 2.5 | — | 45 | 3 | 48 | 0.35 | Conventional example |
| A02 | Balance | 26.0 | 5.0 | 20.0 | 3.0 | 36 | 115 | 3 | 118 | 0.51 | Comparative example |
| A03 | Balance | 24.0 | 10.0 | 20.0 | 3.0 | 36 | 80 | 3 | 83 | 0.38 | Practical example |
| A04 | Balance | 20.6 | 20.0 | 20.0 | 3.0 | 36 | 42 | 3 | 45 | 0.15 | Practical example |
| A05 | Balance | 17.0 | 30.0 | 20.0 | 3.0 | 36 | 35 | 3 | 38 | 0.13 | Practical example |
| A06 | Balance | 13.4 | 40.0 | 20.0 | 3.0 | 36 | 45 | 5 | 50 | 0.16 | Practical example |
| A07 | Balance | 9.7 | 50.0 | 20.0 | 3.0 | 36 | 99 | 21 | 120 | 0.21 | Comparative example |

In the sample No. A01 in Table A-1, a conventional hard phase forming alloy powder was used. In the samples Nos. A02 to A07, the amount of Mo in a conventional hard phase forming alloy powder was decreased, 36% of Co was substituted by Fe, and the amount of Cr was changed in the range of 5 to 50%. According to these samples, the influence of the amount of Cr in the hard phase forming alloy powder was investigated.

In the sample No. A02 in which the amount of Cr in the hard phase forming alloy powder was 5%, the wear amount of the valve sheet was large because Fe was included in the hard phase forming alloy powder and the amount of Cr was insufficient. Moreover, the corrosion loss was large because Fe was included in the hard phase forming alloy powder. In the sample No. A03 in which the amount of Cr in the hard phase forming alloy powder was 10%, the amount of Cr was increased, whereby the wear amount of the valve sheet and the corrosion loss were decreased, but these values were large. On the other hand, in the samples Nos. A04 to A06 in which the amount of Cr in the hard phase forming alloy powder was 20 to 40%, the wear amount was equal to or less than that of the sample No. A01 (conventional example) because the matrix was strengthened by Cr. Moreover, the corrosion loss was not more than half that of the sample No. A01 (conventional example) because corrosion resistance was improved by Cr. In the sample No. A06 in which the amount of Cr in the hard phase forming alloy powder was 40%, as described above, although wear resistance and corrosion resistance were good, the wear amount and the corrosion loss were slightly increased, compared with the sample No. A05 in which the amount of Cr in the hard phase forming alloy powder was 30%. This is because, in the sample No. A06, the oxide films on the surfaces of the hard phase forming alloy powder particles were hardened by the increase in the amount of Cr, whereby hardness of the hard phase forming alloy powder was increased, and compressibility of the raw powder was decreased. As a result, the density of the green compact was decreased, and the density of the sintered compact was decreased. In the sample No. A07 in which the amount of Cr in the hard phase forming alloy powder was greater than 40%, the influence of the decrease in the density of the sintered compact was remarkable, and the strength of the sintered compact was decreased. That is, the wear amount of the valve sheet was remarkably increased, and the wear amount of the valve was also remarkably increased because wear particles of the valve sheet eroded the valve. Moreover, pitting corrosion was easily caused, whereby the corrosion loss was increased. According to the above results, when the amount of Cr in the hard phase forming alloy powder was 20 to 40%, the obtained sintered alloys had not less than approximately equal wear resistance and superior corrosion resistance, compared with a case of using the conventional hard phase forming alloy powder.

Example A-2

The iron powder, the copper powder, the graphite powder used in the example A-1, and a hard phase forming alloy powder having a composition shown in Table A-2 were added and mixed in the same ratio as in the example A-1, and a raw powder was obtained. The obtained raw powder was compacted and sintered in the same way as in the example A-1, and samples Nos. A08 to A13 were formed. The wear tests were performed in the same way as in the example A-1 for these samples. The results and the values of the samples Nos. A01 and A05 are shown in Table A-2.

TABLE A-2

| Sample | Compositions of hard phase forming alloy powder mass % | | | | | Substitutional ratio | Wear amount μm | | | |
|---|---|---|---|---|---|---|---|---|---|---|
| No. | Co | Fe | Cr | Mo | Si | of Fe | Valve sheet | Valve | Total | Notes |
| A01 | Balance | — | 8.00 | 28.00 | 2.50 | — | 45 | 3 | 48 | Conventional example |
| A08 | Balance | — | 30.00 | 20.00 | 3.00 | — | 25 | 3 | 28 | Conventional example |
| A09 | Balance | 7.00 | 30.00 | 20.00 | 3.00 | 15 | 30 | 3 | 33 | Practical example |
| A05 | Balance | 17.00 | 30.00 | 20.00 | 3.00 | 36 | 35 | 3 | 38 | Practical example |
| A10 | Balance | 28.20 | 30.00 | 20.00 | 3.00 | 60 | 37 | 3 | 40 | Practical example |
| A11 | Balance | 37.60 | 30.00 | 20.00 | 3.00 | 80 | 45 | 4 | 49 | Practical example |
| A12 | Balance | 42.30 | 30.00 | 20.00 | 3.00 | 90 | 78 | 5 | 83 | Comparative example |
| A13 | — | 47.00 | 30.00 | 20.00 | 3.00 | 100 | 171 | 10 | 181 | Practical example |

According to Table A-2, when Co in the hard phase forming alloy powder was substituted by Fe, the influence of the substitutional ratio of Fe was investigated. The substitutional ratio is a percentage of the amount of Fe in the hard phase forming alloy powder to the sum total of the amount of Co and Fe in the hard phase forming alloy powder. In the sample No. A08, Co in the hard phase forming alloy powder was not substituted by Fe, and the wear amount was the least among the above examples A and wear resistance was good. When Co in the hard phase forming alloy powder was substituted by Fe and the substitutional ratio of Fe was increased, the wear amount was increased. In this case, when the substitutional ratio of Fe was not more than 80%, the wear amount was approximately equal to or less than that of the sample No. A01 (conventional example). However, when the substitutional ratio of Fe was more than 80%, the effect of Co was insufficient and the wear amount was increased remarkably. According to the above results, although Co in the hard phase forming alloy powder could be substituted by Fe, the substitutional ratio of Fe should be not more than 80%.

Example A-3

The iron powder, the copper powder, the graphite powder used in the example A-1, and a hard phase forming alloy powder having a composition shown in Table A-3 were added and mixed in the same ratio as in the example A-1, and a raw powder was obtained. The obtained raw powder was compacted and sintered in the same way as in the example A-1, and samples Nos. A14 to A17 were formed. The wear tests were performed in the same way as in the example A-1 for these samples. The results and the values of the samples Nos. A01 and A05 are shown in Table A-3.

TABLE A-3

| Sample No. | Compositions of hard phase forming alloy powder mass % Co | Fe | Cr | Mo | Si | Substitutional ratio of Fe | Wear amount μm Valve sheet | Valve | Total | Notes |
|---|---|---|---|---|---|---|---|---|---|---|
| A01 | Balance | — | 8.00 | 28.00 | 2.50 | 0.0 | 45 | 3 | 48 | Conventional example |
| A05 | Balance | 17.00 | 30.00 | 20.00 | 3.00 | 36.2 | 35 | 3 | 38 | Practical example |
| A14 | Balance | 17.00 | 30.00 | 20.00 | 3.00 | 36.2 | 32 | 3 | 35 | Practical example |
| A15 | Balance | 17.00 | 30.00 | 20.00 | 3.00 | 36.2 | 27 | 4 | 31 | Practical example |
| A16 | Balance | 17.00 | 30.00 | 20.00 | 3.00 | 36.2 | 35 | 12 | 47 | Practical example |
| A17 | Balance | 17.00 | 30.00 | 20.00 | 3.00 | 36.2 | 68 | 46 | 114 | Comparative example |

According to Table A-3, the effect of Mn in the hard phase forming alloy powder was investigated. In the samples Nos. A14 to A16 in which the amount of Mn in the hard phase forming alloy powder was not more than 5%, the alloy matrixes of hard phases were strengthened by Mn, whereby the wear amounts of the valve sheets were approximately equal to or less than that of the sample No. A05 in which Mn was not added in the hard phase forming alloy powder. On the other hand, the wear amounts of the valves were slightly increased according to the increase in the amount of Mn because hard phases were strengthened. In the sample No. A17 in which the amount of Mn in the hard phase forming alloy powder was greater than 5%, the wear amount of the valve sheet was remarkably increased. This is because the hard phase forming alloy powder was hardened by the increase in the amount of Mn, whereby compressibility of the raw powder was remarkably decreased. As a result, the density of the green compact was decreased, and the density of the sintered compact was decreased, whereby the strength of the sintered compact was decreased. Moreover, the wear amount of the valve was also remarkably increased because the wear particles of the valve sheet eroded the valve. According to the above results, although wear resistance of the sintered alloy could be further improved by adding Mn in the hard phase forming alloy powder, the amount of Mn in the hard phase forming alloy powder should be not more than 5%.

Example B

Fe—Ni—C Alloy Matrix

Example B-1

An ore-reduced iron powder consisting of 1% of metal oxides and the balance of Fe and inevitable impurities, a nickel powder, a hard phase forming alloy powder having a composition shown in Table B-1, and a graphite powder were prepared. These powders were added and mixed with a forming lubricant (0.8% of zinc stearate) in the mixing ratio shown in Table B-1, and a raw powder was obtained. The obtained raw powder was compacted and sintered in the same way as in the example A-1, and samples Nos. B01 to B06 were formed. The simple wear tests and the corrosion tests were performed in the same way as in the example A-1 for these samples. In the simple wear tests, the mating materials were heated with a burner so that the sintered alloys reached 300° C. The results of these tests are also shown in Table B-1.

TABLE B-1

| Sample No. | Mixing ratio mass % Iron powder | Nickel powder | Hard phase forming alloy powder Compositions mass % | | | | | | Graphite powder | Evaluation item Wear amount μm Valve sheet | Valve | Total | Corrosion loss mg/cm² | Notes |
|---|---|---|---|---|---|---|---|---|---|---|---|---|---|---|
| | | | | Co | Fe | Cr | Mo | Si | | | | | | |
| B01 | Balance | 2.00 | 35.00 | Balance | 42.00 | 5.00 | 20.00 | 3.00 | 1.00 | 98 | 3 | 101 | 0.32 | Comparative example |
| B02 | Balance | 2.00 | 35.00 | Balance | 37.00 | 10.00 | 20.00 | 3.00 | 1.00 | 61 | 3 | 64 | 0.17 | Practical example |
| B03 | Balance | 2.00 | 35.00 | Balance | 27.00 | 20.00 | 20.00 | 3.00 | 1.00 | 41 | 3 | 44 | 0.15 | Practical example |
| B04 | Balance | 2.00 | 35.00 | Balance | 17.00 | 30.00 | 20.00 | 3.00 | 1.00 | 30 | 3 | 33 | 0.13 | Practical example |
| B05 | Balance | 2.00 | 35.00 | Balance | 7.00 | 40.00 | 20.00 | 3.00 | 1.00 | 47 | 5 | 52 | 0.16 | Practical example |
| B06 | Balance | 2.00 | 35.00 | Balance | 2.00 | 45.00 | 20.00 | 3.00 | 1.00 | 85 | 21 | 106 | 0.20 | Comparative example |

According to Table B-1, the influence of the amount of Cr in the hard phase forming alloy powder (the amount of Cr in the hard phase) was investigated. In the sample No. B01, the amount of Cr in the hard phase forming alloy powder was insufficient, whereby the matrix of the sintered alloy was not sufficiently strengthened, and the wear amount of the valve sheet was large. In addition, since the amount of Cr was insufficient, the corrosion resistance was insufficient, and the corrosion loss was also large. In the sample No. B02 in which the amount of Cr in the hard phase forming alloy powder was 10%, the wear amount of the valve sheet was remarkably decreased because the matrix was strengthened by Cr, and the corrosion loss was reduced because corrosion resistance was improved by Cr. When the amount of Cr in the hard phase forming alloy powder was not more than 30%, the wear amounts of the valve sheets and the corrosion losses were decreased according to the increase in the amount of Cr. On the other hand, in the sample No. B05 in which the amount of Cr in the hard phase forming alloy powder was 40%, the wear amount of the valve sheet and the corrosion loss were increased. This is because the amount of Cr in the hard phase forming alloy powder was increased, whereby the hardness of the hard phase forming alloy powder was increased. As a result, compressibility of the raw powder was decreased, and the density of the green compact was decreased, whereby the density of the sintered compact was decreased. In the sample No. B06 in which the amount of Cr in the hard phase forming alloy powder was greater than 40%, the wear amount of the valve sheet was increased and the corrosion loss was remarkably increased, because the influence of the decrease of compressibility was remarkable. Moreover, the wear amount of the valve was also remarkably increased because the wear particles of the valve sheet eroded the valve. According to the above results, when the amount of Cr in the hard phase forming alloy powder was 10 to 40%, the wear amounts of the valve sheet and valve were small and the corrosion loss of the sintered alloy was small.

Example B-2

The ore-reduced iron powder used in the example B-1, a nickel powder, a graphite powder, and the hard phase forming alloy powder used in the sample No. B04 in the example B-1 were prepared. The ratio of the hard phase forming alloy powder was changed as shown in Table B-2, these powders were added and mixed with a forming lubricant (0.8% of zinc stearate), and a raw powder was obtained. The obtained raw powder was compacted and sintered in the same way as in the example A-1, and samples Nos. B07 to B11 were formed. The wear tests and the corrosion tests were performed in the same way as in the example B-1 for these samples. The results are shown in Table B-2 with the values of the sample No. B04 in the example B-1.

TABLE B-2

| | Mixing ratio mass % | | | | | | | | | Evaluation item | | | | |
|---|---|---|---|---|---|---|---|---|---|---|---|---|---|---|
| | | | Hard phase forming alloy powder | | | | | | | Wear amount μm | | | Corrosion | |
| Sample | Iron | Nickel | | Compositions mass % | | | | | Graphite | Valve | | | loss | |
| No. | powder | powder | | Co | Fe | Cr | Mo | Si | powder | sheet | Valve | Total | mg/cm$^2$ | Notes |
| B07 | Balance | 2.00 | 5.00 | Balance | 17.00 | 30.00 | 20.00 | 3.00 | 1.00 | 120 | 0 | 120 | 0.56 | Comparative example |
| B08 | Balance | 2.00 | 15.00 | Balance | 17.00 | 30.00 | 20.00 | 3.00 | 1.00 | 58 | 2 | 60 | 0.28 | Practical example |
| B09 | Balance | 2.00 | 25.00 | Balance | 17.00 | 30.00 | 20.00 | 3.00 | 1.00 | 35 | 3 | 38 | 0.18 | Practical example |
| B04 | Balance | 2.00 | 35.00 | Balance | 17.00 | 30.00 | 20.00 | 3.00 | 1.00 | 30 | 3 | 33 | 0.13 | Practical example |
| B10 | Balance | 2.00 | 45.00 | Balance | 17.00 | 30.00 | 20.00 | 3.00 | 1.00 | 49 | 6 | 55 | 0.15 | Practical example |
| B11 | Balance | 2.00 | 55.00 | Balance | 17.00 | 30.00 | 20.00 | 3.00 | 1.00 | 90 | 35 | 125 | 0.26 | Comparative example |

According to Table B-2, the influence of the amount of the hard phase forming alloy powder (the amount of the hard phase dispersed in the matrix) was investigated. In the sample No. B07 in which the amount of the hard phase forming alloy powder was less than 15%, the wear amount of the valve sheet was large because the amount of the hard phase was insufficient and the plastic flow of the matrix could not be prevented. Moreover, the corrosion loss was large because the hard phase was insufficient and Cr was not sufficiently dispersed from the hard phase to the matrix. In the sample No. B08 in which the amount of the hard phase forming alloy powder was 15%, wear resistance and corrosion resistance of the matrix of the sintered alloy were improved by the hard phase, whereby the wear amount of the valve sheet was remarkably decreased and the corrosion loss was decreased. When the amount of the hard phase forming alloy powder was not more than 35%, the wear amount of the valve sheet and the corrosion loss were decreased according to the increase in the amount of the hard phase forming alloy powder. On the other hand, in the sample No. B10 in which the amount of the hard phase forming alloy powder was 45%, the wear amount of the valve sheet and the corrosion loss were slightly increased because compressibility of the raw powder was decreased by the increase in the amount of the hard phase forming alloy powder. In the sample No. B11 in which the amount of the hard phase forming alloy powder was greater than 45%, the influence of the decrease of compressibility was remarkable, whereby the wear amount of the valve sheet was remarkably increased, and the corrosion loss was increased. Moreover, the wear amount of the valve also was remarkably increased because the wear particles of the valve sheet eroded the valve. According to the above results, when the amount of the hard phase forming alloy powder (the amount of the hard phase dispersed in the matrix) was 15 to 45%, the wear amounts of the valve sheet and the valve were small.

Example B-3

The ore-reduced iron powder used in the example B-1, a nickel powder, a graphite powder, and the hard phase forming alloy powder used in the sample No. B04 in the example B-1 were prepared. The ratio of the nickel powder was changed as shown in Table B-3, these powders were added and mixed with a forming lubricant (0.8% of zinc stearate), and a raw powder was obtained. The obtained raw powder was compacted and sintered in the same way as in the example A-1, and samples Nos. B12 to B17 were formed. The wear tests were performed in the same way as in the example B-1 for these samples. The results are shown in Table B-3 with the values of the sample No. B04 in the example B-1.

TABLE B-3

| Sample No. | Mixing ratio mass % Iron powder | Nickel powder | Hard phase forming alloy powder Compositions mass % Co | Fe | Cr | Mo | Si | Graphite powder | Evaluation item Wear amount μm Valve sheet | Valve | Total | Notes |
|---|---|---|---|---|---|---|---|---|---|---|---|---|
| B12 | Balance | — | 35.00 | Balance | 17.00 | 30.00 | 20.00 | 3.00 | 1.00 | 102 | 2 | 104 | Comparative example |
| B13 | Balance | 1.00 | 35.00 | Balance | 17.00 | 30.00 | 20.00 | 3.00 | 1.00 | 51 | 3 | 54 | Practical example |
| B04 | Balance | 2.00 | 35.00 | Balance | 17.00 | 30.00 | 20.00 | 3.00 | 1.00 | 30 | 3 | 33 | Practical example |
| B14 | Balance | 3.00 | 35.00 | Balance | 17.00 | 30.00 | 20.00 | 3.00 | 1.00 | 26 | 3 | 29 | Practical example |
| B15 | Balance | 4.00 | 35.00 | Balance | 17.00 | 30.00 | 20.00 | 3.00 | 1.00 | 33 | 3 | 36 | Practical example |
| B16 | Balance | 5.00 | 35.00 | Balance | 17.00 | 30.00 | 20.00 | 3.00 | 1.00 | 56 | 4 | 60 | Practical example |
| B17 | Balance | 6.00 | 35.00 | Balance | 17.00 | 30.00 | 20.00 | 3.00 | 1.00 | 94 | 5 | 99 | Comparative example |

According to Table B-3, the influence of the amount of the nickel powder (the amount of Ni in the overall composition) was investigated. In the sample No. B12 in which the nickel powder was not added, the wear amount of the valve sheet was large because the Fe matrix of the sintered alloy was not strengthened. In the sample No. B13 in which the amount of the nickel powder was 1%, the wear amount of the valve sheet was remarkably decreased because the Fe matrix was strengthened by Ni. When the amount of the nickel powder was not more than 3%, the wear amount of the valve sheet was decreased according to the increase in the amount of the nickel powder. On the other hand, in the samples Nos. B15 and B16 in which the amount of the nickel powder was 4 to 5%, the wear amounts of the valve sheet were slightly increased because the amount of soft residual austenite phase was increased. In the sample No. B17 in which the amount of the nickel powder was greater than 5%, the wear amount of the valve sheet was remarkably increased because the amount of the soft residual austenite phase was too large. According to the above results, when the amount of the nickel powder (the amount of Ni in the overall composition) was 1 to 5%, the wear amount of the valve sheet was small.

Example B-4

The ore-reduced iron powder used in the example B-1, a nickel powder, a graphite powder, and the hard phase forming alloy powder used in the sample No. B04 in the example B-1 were prepared. The ratio of the graphite powder was changed as shown in Table B-4, these powders were added and mixed with a forming lubricant (0.8% of zinc stearate), and a raw powder was obtained. The obtained raw powder was compacted and sintered in the same way as in the example A-1, and samples Nos. B18 to B23 were formed. The wear tests were performed in the same way as in the example B-1 for these samples. The results are shown in Table B-4 with the values of the sample No. B04 in the example B-1.

TABLE B-4

| Sample No. | Mixing ratio mass % Iron powder | Nickel powder | Hard phase forming alloy powder Compositions mass % Co | Fe | Cr | Mo | Si | Graphite powder | Evaluation item Wear amount μm Valve sheet | Valve | Total | Notes |
|---|---|---|---|---|---|---|---|---|---|---|---|---|
| B18 | Balance | 2.00 | 35.00 | Balance | 17.00 | 30.00 | 20.00 | 3.00 | 0.30 | 125 | 2 | 127 | Comparative example |
| B19 | Balance | 2.00 | 35.00 | Balance | 17.00 | 30.00 | 20.00 | 3.00 | 0.50 | 67 | 3 | 70 | Practical example |
| B20 | Balance | 2.00 | 35.00 | Balance | 17.00 | 30.00 | 20.00 | 3.00 | 0.80 | 36 | 3 | 39 | Practical example |
| B04 | Balance | 2.00 | 35.00 | Balance | 17.00 | 30.00 | 20.00 | 3.00 | 1.00 | 30 | 3 | 33 | Practical example |
| B21 | Balance | 2.00 | 35.00 | Balance | 17.00 | 30.00 | 20.00 | 3.00 | 1.20 | 36 | 4 | 40 | Practical example |
| B22 | Balance | 2.00 | 35.00 | Balance | 17.00 | 30.00 | 20.00 | 3.00 | 1.50 | 65 | 8 | 73 | Practical example |
| B23 | Balance | 2.00 | 35.00 | Balance | 17.00 | 30.00 | 20.00 | 3.00 | 1.80 | 113 | 42 | 155 | Comparative example |

According to Table B-4, the influence of the amount of the graphite powder (the amount of C in the overall composition) was investigated. In the sample No. B18 in which the amount of the graphite powder was less than 0.5%, the wear amount of the valve sheet was large because Fe matrix of the sintered alloy was not sufficiently strengthened. In the sample No. B19 in which the amount of the graphite powder was 0.5%, the wear amount of the valve sheet was remarkably decreased because the Fe matrix of the sintered alloy was strengthened. When the amount of the graphite powder was not more than 1.0%, the wear amount of the valve sheet was decreased according to the increase in the amount of the graphite powder. On the other hand, in the samples Nos. B21 and B22 in which the amount of the graphite powder was greater than 1.0%, the wear amounts of valve sheet were increased because the Fe matrix of the sintered alloy was hardened and embrittled. In the sample No. B23 in which the amount of the graphite powder was greater than 1.5%, this tendency was more remarkable, and therefore the wear amount of the valve sheet was remarkably increased. Moreover, the wear amount of the valve was also remarkably increased because the wear particles of the valve sheet eroded the valve. According to the above results, when the amount of the graphite powder (the amount of C in the overall composition) was 0.5 to 1.5%, the wear amounts of the valve sheet and the valve were small.

Example B-5

The ore-reduced iron powder used in the example B-1, a nickel powder, a graphite powder, and a hard phase forming alloy powder having a composition shown in Table B-5 were prepared. These powders were added and mixed with a forming lubricant (0.8% of zinc stearate) in the mixing ratio shown in Table B-5, and a raw powder was obtained. The obtained raw powder as compacted and sintered in the same way as in the example A-1, and samples Nos. B24 to B29 were formed. The wear tests were performed in the same way as in the example B-1 for these samples. The results are shown in Table B-5 with the values of the sample No. B04 in the example B-1.

According to Table B-5, when Co in the hard phase forming alloy powder was substituted by Fe, the influence of the substitutional ratio of Fe was investigated. In the sample No. B24 in which Co in the hard phase forming alloy powder was not substituted by Fe, the total of the wear amounts was the least among the above examples B, and wear resistance was good. When Co in the hard phase forming alloy powder was substituted by Fe and the substitutional ratio of Fe was increased, the total of the wear amounts was increased. In this case, when the substitutional ratio of Fe was not more than 80%, wear amounts were not a problem in practical use. On the other hand, when the substitutional ratio of Fe was more than 80%, the wear amounts were remarkably increased because the effect of Co was insufficient. According to the above results, although Co in the hard phase forming alloy powder could be substituted by Fe, the substitutional ratio of Fe should be not more than 80%.

Example B-6

The ore-reduced iron powder used in the example B-1, a nickel powder, a graphite powder, and a hard phase forming alloy powder having a composition shown in Table B-6 were prepared. These powders were added and mixed with a forming lubricant (0.8% of zinc stearate) in the mixing ratio shown in Table B-6, and a raw powder was obtained. The obtained raw powder was compacted and sintered in the same way as in the example A-1, and samples Nos. B30 to B33 were formed. The wear tests were performed in the same way as in the example B-1 for these samples. The results are shown in Table B-6 with the values of the sample No. B04 in the example B-1.

TABLE B-5

| | Mixing ratio mass % | | | | | | | | | | Evaluation item | | | |
|---|---|---|---|---|---|---|---|---|---|---|---|---|---|---|
| | | | Hard phase forming alloy powder | | | | | | | | Wear amount μm | | | |
| Sample | Iron | Nickel | Compositions mass % | | | | | Substitutional | Graphite | Valve | | | | |
| No. | powder | powder | Co | Fe | Cr | Mo | Si | ratio of Fe | powder | sheet | Valve | Total | Notes |
| B24 | Balance | 2.00 | 35.00 | Balance | 0.00 | 30.00 | 20.00 | 3.00 | 0.00 | 1.00 | 21 | 3 | 24 | Comparative example |
| B25 | Balance | 2.00 | 35.00 | Balance | 7.00 | 30.00 | 20.00 | 3.00 | 14.90 | 1.00 | 26 | 3 | 29 | Practical example |
| B04 | Balance | 2.00 | 35.00 | Balance | 17.00 | 30.00 | 20.00 | 3.00 | 36.20 | 1.00 | 30 | 3 | 33 | Practical example |
| B26 | Balance | 2.00 | 35.00 | Balance | 27.00 | 30.00 | 20.00 | 3.00 | 57.40 | 1.00 | 34 | 3 | 37 | Practical example |
| B27 | Balance | 2.00 | 35.00 | Balance | 37.00 | 30.00 | 20.00 | 3.00 | 78.70 | 1.00 | 57 | 4 | 61 | Practical example |
| B28 | Balance | 2.00 | 35.00 | Balance | 42.00 | 30.00 | 20.00 | 3.00 | 89.40 | 1.00 | 101 | 5 | 106 | Practical example |
| B29 | Balance | 2.00 | 35.00 | Balance | 47.00 | 30.00 | 20.00 | 3.00 | 100.00 | 1.00 | 145 | 10 | 155 | Comparative example |

TABLE B-6

| Sample No. | Mixing ratio mass % Iron powder | Nickel powder | Hard phase forming alloy powder Compositions mass % Co | Fe | Cr | Mo | Si | Mn | Graphite powder | Evaluation item Wear amount μm Valve sheet | Valve | Total | Notes |
|---|---|---|---|---|---|---|---|---|---|---|---|---|---|
| B04 | Balance | 2.00 | 35.00 Balance | 17.00 | 30.00 | 20.00 | 3.00 | — | 1.00 | 30 | 3 | 33 | Practical example |
| B30 | Balance | 2.00 | 35.00 Balance | 17.00 | 30.00 | 20.00 | 3.00 | 1.00 | 1.00 | 27 | 3 | 30 | Practical example |
| B31 | Balance | 2.00 | 35.00 Balance | 17.00 | 30.00 | 20.00 | 3.00 | 3.00 | 1.00 | 23 | 4 | 27 | Practical example |
| B32 | Balance | 2.00 | 35.00 Balance | 17.00 | 30.00 | 20.00 | 3.00 | 5.00 | 1.00 | 28 | 10 | 38 | Practical example |
| B33 | Balance | 2.00 | 35.00 Balance | 17.00 | 30.00 | 20.00 | 3.00 | 6.00 | 1.00 | 54 | 46 | 100 | Comparative example |

According to Table B-6, the effect of Mn in the hard phase forming alloy powder was investigated. In the samples Nos. B30 to B32 in which the amount of Mn in the hard phase forming alloy powder was not more than 5%, the alloy matrix of the hard phase was strengthened by Mn, whereby the wear amounts of the valve sheets were less than that of the sample No. B04 in which Mn in the hard phase forming alloy powder was not added. On the other hand, the wear amounts of the valves were slightly increased according to the increase in the amount of Mn because the hard phases were strengthened. In the sample No. B33 in which Mn in the hard phase forming alloy powder was more than 5%, the hard phase forming alloy powder was hardened, and the compressibility of the raw powder was greatly decreased. As a result, the wear amount of the valve sheet was remarkably increased, and the wear amount of the valve was also remarkably increased because the wear particles of the valve sheet eroded the valve. According to the above results, although wear resistance of the sintered alloy could be further improved by adding Mn in the hard phase forming alloy powder, the amount of Mn in the hard phase forming alloy powder should be not more than 5%.

Example B-7

The nickel powder used in the example B-1, a hard phase forming alloy powder, a graphite powder, and an ore-reduced iron powder in which the amount of metal oxides was different as shown in Table B-7 were prepared. These powders were added and mixed with a forming lubricant (0.8% of zinc stearate) in the mixing ratio shown in Table B-7, and a raw powder was obtained. The obtained raw powder was compacted and sintered in the same way as in the example A-1, and samples Nos. B34 to B38 were formed. The wear tests were performed in the same way as in the example B-1 for these samples. Moreover, in the example B-7, machinability tests were performed. In the machinability tests, holes were made in the samples with a constant load by using a bench drill, and the numbers of the machined holes were compared. In these tests, the load was 1.3 kg, the drill was a carbide drill with a diameter of 3 mm, and the thickness of sample was 5 mm. The numbers of the machined holes in these machinability tests are shown in Table B-7.

TABLE B-7

| Sample No. | Mixing ratio mass % Iron powder | Metal oxide | Nickel powder | Hard phase forming alloy powder Compositions mass % Co | Fe | Cr | Mo | Si | Graphite powder | Evaluation item Wear amount μm Valve sheet | Valve | Total | Number of machined holes | Notes |
|---|---|---|---|---|---|---|---|---|---|---|---|---|---|---|
| B34 | Balance | 0.20 | 2.00 | 35.00 Balance | 17.00 | 30.00 | 20.00 | 3.00 | 1.00 | 32 | 3 | 35 | 5 | Comparative example |
| B35 | Balance | 0.30 | 2.00 | 35.00 Balance | 17.00 | 30.00 | 20.00 | 3.00 | 1.00 | 31 | 3 | 34 | 11 | Practical example |
| B04 | Balance | 1.00 | 2.00 | 35.00 Balance | 17.00 | 30.00 | 20.00 | 3.00 | 1.00 | 30 | 3 | 33 | 20 | Practical example |
| B36 | Balance | 0.50 | 2.00 | 35.00 Balance | 17.00 | 30.00 | 20.00 | 3.00 | 1.00 | 30 | 3 | 33 | 15 | Practical example |
| B37 | Balance | 1.50 | 2.00 | 35.00 Balance | 17.00 | 30.00 | 20.00 | 3.00 | 1.00 | 41 | 10 | 51 | 23 | Practical example |
| B38 | Balance | 2.00 | 2.00 | 35.00 Balance | 17.00 | 30.00 | 20.00 | 3.00 | 1.00 | 95 | 36 | 131 | 25 | Comparative example |

According to Table B-7, the influence of the amount of metal oxides in the ore-reduced iron powder (the amount of metal oxides in the matrix of the sintered alloy) was investigated. In the samples Nos. B34 to B36 and B04 in which the amount of metal oxides in the ore-reduced iron powder was 0.2 to 1.0%, the wear amounts were approximately equal. On the other hand, in the sample No. B37 in which the amount of metal oxides in the ore-reduced iron powder was 1.5%, the iron powder was hardened by the increase in the metal oxides in the ore-reduced iron powder, whereby the compressibility of the raw powder was decreased, and the wear amounts were increased. In the sample No. B38 in which the amount of metal oxides in the ore-reduced iron powder was greater than 1.5%, the wear amount was remarkably increased because compressibility of the raw powder was remarkably decreased. In the sample No. B34 in which the amount of metal oxides in the ore-reduced iron powder was 0.2%, there were 5 machined holes, and the machinability was not good. On the other hand, in the sample No. B35 in which the amount of metal oxides in the ore-reduced iron powder was 0.3%, the number of the machined holes was 11, and the machinability was improved and was more than twice the number of the machined holes of the sample No. B34. When the amount of metal oxides was further increased, the numbers of the machined holes were increased and the machinability was improved. However, in the sample No. B38 in which the amount of metal oxides in the ore-reduced iron powder was greater than 1.5%, the effect of the machinability improvement was insufficient. Accordingly, the amount of metal oxides in the ore-reduced iron powder (the amount of metal oxides in the matrix of the sintered alloy) was preferably not less than 0.3% from the viewpoint of machinability, and preferably not more than 1.5% from the viewpoint of wear resistance and machinability.

Example C

Fe—Cr—C Alloy Matrix

Example C-1

An iron alloy powder consisting of 3% of Cr and the balance of Fe and inevitable impurities, a hard phase forming alloy powder having a composition shown in Table C-1, and a graphite powder were prepared. The iron alloy powder, 35% of the hard phase forming alloy powder, and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. C01 to C06 were formed. The simple wear tests and the corrosion tests were performed in the same way as in the example A-1 for these samples. In the simple wear tests, the mating materials were heated with a burner so that the sintered alloys reached 300° C., and the colliding frequency was 3000 times per minute, and the time during which this was conducted was 15 hours. The results of these tests are also shown in Table C-1.

According to Table C-1, the influence of the amount of Cr in the hard phase forming alloy powder (the amount of Cr in the hard phase) was investigated. In the sample No. C01, the amount of Cr in the hard phase forming alloy powder was insufficient, whereby corrosion resistance was insufficient and the corrosion loss was large. Moreover, since the amount of Cr was insufficient, the matrix of the sintered alloy was not sufficiently strengthened, and the wear amount of the valve sheet was also large. On the other hand, in the sample No. C02 in which the amount of Cr in the hard phase forming alloy powder was 10%, the corrosion loss was reduced because corrosion resistance was improved by Cr, and the wear amount of the valve sheet was remarkably decreased because the matrix was strengthened by Cr. When the amount of Cr in the hard phase forming alloy powder was not more than 30%, the wear amounts of the valve sheets were at low levels, and the corrosion losses were reduced to low levels according to the increase in the amount of Cr. In the sample No. C05 in which the amount of Cr in the hard phase forming alloy powder was 40%, the hardness of the hard phase forming alloy powder was increased by the increase in the amount of Cr in the hard phase forming alloy powder, whereby the compressibility of the raw powder was decreased, and the density of the green compact was decreased. As a result, the density of the sintered compact was decreased, whereby the wear amount of the valve sheet and the corrosion loss were increased, but these values were sufficiently small. Moreover, the wear particles of the valve sheet eroded the valve, and the wear amount of the valve was also increased, but this value was small. In the sample No. C06 in which the amount of Cr in the hard phase forming alloy powder was greater than 40%, this tendency was more remarkable, and therefore the total of the wear amounts and the corrosion loss were remarkably increased. According to the above results, when the amount of Cr in the hard phase forming alloy powder was 10 to 40%, the wear amounts of the valve sheet and the valve were small and the corrosion loss of the sintered alloy was small.

Example C-2

The iron alloy powder (Fe-3% Cr powder) used in the example C-1 the hard phase forming alloy powder (Co-30%

TABLE C-1

| | Mixing ratio mass % | | | | | | | | Evaluation item | | | | |
|---|---|---|---|---|---|---|---|---|---|---|---|---|---|
| | | Hard phase forming alloy powder | | | | | | | Wear amount μm | | | Corrosion | |
| Sample | Iron alloy | | Compositions mass % | | | | | Graphite | Valve | | | loss | |
| No. | powder | | Co | Fe | Cr | Mo | Si | powder | sheet | Valve | Total | mg/cm$^2$ | Notes |
| C01 | Balance | 35.00 | Balance | 42.00 | 5.00 | 20.00 | 3.00 | 1.00 | 83 | 3 | 86 | 0.31 | Comparative example |
| C02 | Balance | 35.00 | Balance | 37.00 | 10.00 | 20.00 | 3.00 | 1.00 | 52 | 4 | 56 | 0.15 | Practical example |
| C03 | Balance | 35.00 | Balance | 27.00 | 20.00 | 20.00 | 3.00 | 1.00 | 35 | 4 | 39 | 0.12 | Practical example |
| C04 | Balance | 35.00 | Balance | 17.00 | 30.00 | 20.00 | 3.00 | 1.00 | 26 | 4 | 30 | 0.10 | Practical example |
| C05 | Balance | 35.00 | Balance | 7.00 | 40.00 | 20.00 | 3.00 | 1.00 | 40 | 6 | 46 | 0.13 | Practical example |
| C06 | Balance | 35.00 | Balance | 2.00 | 45.00 | 20.00 | 3.00 | 1.00 | 72 | 25 | 97 | 0.23 | Comparative example |

Cr-20% Mo-17% Fe-3% Si powder) used in the sample No. C04 in the example C-1, and a graphite powder were prepared. The ratio of the hard phase forming alloy powder was changed as shown in Table C-2, and these powders were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. C07 to C11 were formed. The wear tests and the corrosion tests were performed in the same way as in the example C-1 for these samples. The results are shown in Table C-2 with the values of the sample No. C04 in the example C-1

TABLE C-2

| | Mixing ratio mass % | | | Evaluation item | | | | |
|---|---|---|---|---|---|---|---|---|
| | | Hard phase forming | | Wear amount μm | | | Corrosion | |
| Sample No. | Iron alloy powder | alloy powder | Graphite powder | Valve sheet | Valve | Total | loss mg/cm$^2$ | Notes |
| C07 | Balance | 5.00 | 1.00 | 102 | 2 | 104 | 0.53 | Comparative example |
| C08 | Balance | 15.00 | 1.00 | 49 | 3 | 52 | 0.24 | Practical example |
| C09 | Balance | 25.00 | 1.00 | 30 | 4 | 34 | 0.14 | Practical example |
| C04 | Balance | 35.00 | 1.00 | 26 | 4 | 30 | 0.10 | Practical example |
| C10 | Balance | 45.00 | 1.00 | 42 | 9 | 51 | 0.15 | Practical example |
| C11 | Balance | 55.00 | 1.00 | 77 | 36 | 113 | 0.30 | Comparative example |

According to Table C-2, the influence of the amount of the hard phase forming alloy powder (the amount of the hard phase dispersed in the matrix) was investigated. In the sample No. C07 in which the amount of the hard phase forming alloy powder was less than 15%, the wear amount of the valve sheet was large, because the amount of the hard phase was insufficient and the plastic flow of the matrix could not be prevented. Moreover, the corrosion loss was large, because the hard phase was insufficient and Cr was not sufficiently dispersed from the hard phase to the matrix. On the other hand, in the sample No. C08 in which the amount of the hard phase forming alloy powder was 15%, wear resistance and corrosion resistance of the matrix of the sintered alloy were improved by the hard phase, and the wear amount of the valve sheet was remarkably decreased and the corrosion loss was decreased. When the amount of the hard phase forming alloy powder was not more than 35%, the wear amount of the valve sheet and the corrosion loss were decreased according to the increase in the amount of the hard phase forming alloy powder. In the sample No. C10 in which the amount of the hard phase forming alloy powder was 45%, compressibility of the raw powder was decreased by the increase in the amount of the hard phase forming alloy powder, whereby the wear amount of the valve sheet and the corrosion loss were slightly increased, but these were at low levels. In the sample No. C11 in which the amount of the hard phase forming alloy powder was greater than 45%, the wear amount of the valve sheet was remarkably increased and the corrosion loss was increased, because the influence of the decrease of compressibility was remarkable. Moreover, the wear amount of the valve was also remarkably increased because the wear particles of the valve sheet eroded the valve. According to the above results, when the amount of the hard phase forming alloy powder (the amount of the hard phase dispersed in the matrix) was 15 to 45%, the wear amounts of the valve sheet and the valve were small.

Example C-3

An iron alloy powder having a composition shown in Table C-3, a graphite powder, and the hard phase forming alloy powder (Co-30% Cr-20% Mo-17% Fe-3% Si powder) used in the sample No. C04 in the example C-1 were prepared. The iron alloy powder, 35% of the hard phase forming alloy powder, and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. C12 to C17 were formed. The wear tests and the corrosion tests were performed in the same way as in the example C-1 for these samples. The results are shown in Table C-3 with the values of the sample No. C04 in the example C-1.

TABLE C-3

| Sample No. | Mixing ratio mass % Iron alloy powder compositions Fe | Cr | Hard phase forming alloy powder | Graphite powder | Evaluation item Wear amount μm Valve sheet | Valve | Total | Corrosion loss mg/cm$^2$ | Notes |
|---|---|---|---|---|---|---|---|---|---|
| C12 | Balance | 0.00 | 35.00 | 1.00 | 103 | 3 | 106 | 0.22 | Comparative example |
| C13 | Balance | 1.00 | 35.00 | 1.00 | 43 | 4 | 47 | 0.16 | Practical example |
| C14 | Balance | 2.00 | 35.00 | 1.00 | 30 | 4 | 34 | 0.13 | Practical example |
| C04 | Balance | 3.00 | 35.00 | 1.00 | 26 | 4 | 30 | 0.10 | Practical example |
| C15 | Balance | 4.00 | 35.00 | 1.00 | 29 | 4 | 33 | 0.09 | Practical example |
| C16 | Balance | 5.00 | 35.00 | 1.00 | 48 | 5 | 53 | 0.16 | Practical example |
| C17 | Balance | 6.00 | 35.00 | 1.00 | 80 | 6 | 86 | 0.25 | Comparative example |

According to Table C-3, the influence of the amount of Cr in the iron alloy powder was investigated. In the sample No. C12 using a pure iron powder in which Cr was not added, the wear amount of the valve sheet and the corrosion loss were large because Fe matrix of the sintered alloy was not strengthened. In the sample No. C13 in which the amount of Cr in the iron alloy powder was 1%, the wear amount of the valve sheet was remarkably decreased because the Fe matrix was strengthened by Cr, and the corrosion loss was decreased because the corrosion resistance of the Fe matrix was improved. When the amount of Cr in the iron alloy powder was not more than 3%, the wear amount of the valve sheet and the corrosion loss were decreased according to the increase in the amount of Cr in the iron alloy powder. In the samples Nos. C15 and C16 in which the amount of Cr in the iron alloy powder was 4 to 5%, the hardness of the iron alloy powder was increased, whereby compressibility of the raw powder was decreased, and the density of the green compact was decreased. As a result, the density of the sintered compact was decreased, whereby the wear amount of the valve sheet and the corrosion loss were slightly increased, but these were at low levels. On the other hand, in the sample No. C17 in which the amount of Cr in the iron alloy powder was greater than 5%, the influence of the increase in the hardness of the iron alloy powder was remarkable, and the density of the sintered compact was remarkably decreased, whereby the wear amount of the valve sheet and the corrosion loss were remarkably increased. According to the above results, when the amount of Cr in the iron alloy powder was 1 to 5%, the wear amount of the valve sheet was small and the corrosion loss was reduced.

Example C-4

The iron alloy powder (Fe-3% Cr powder) used in the example C-1 the hard phase forming alloy powder (Co-30% Cr-20% Mo-17% Fe-3% Si powder) used in the sample No. C04 in the example C-1, and a graphite powder were prepared. The ratio of the graphite powder was changed as shown in Table C-4, and these powders were added and mixed. Furthermore, 0.8 mass parts of zinc stearate as a forming lubricant was added and mixed with 100 mass parts of the mixed powder, and a raw powder as obtained. The obtained raw powder was compacted and sintered in the same way as in the example A-1, and samples Nos. C18 to C23 were formed. The wear tests were performed in the same way as in the example C-1 for these samples. The results are shown in Table C-4 with the values of the sample No. C04 in the example C-1.

TABLE C-4

| Sample No. | Mixing ratio mass % Iron alloy powder | Hard phase forming alloy powder | Graphite powder | Evaluation item Wear amount μm Valve sheet | Valve | Total | Notes |
|---|---|---|---|---|---|---|---|
| C18 | Balance | 35.00 | 0.30 | 107 | 3 | 110 | Comparative example |
| C19 | Balance | 35.00 | 0.50 | 57 | 4 | 61 | Practical example |
| C20 | Balance | 35.00 | 0.80 | 31 | 4 | 35 | Practical example |
| C04 | Balance | 35.00 | 1.00 | 26 | 4 | 30 | Practical example |
| C21 | Balance | 35.00 | 1.20 | 30 | 5 | 35 | Practical example |
| C22 | Balance | 35.00 | 1.50 | 55 | 9 | 64 | Practical example |
| C23 | Balance | 35.00 | 1.80 | 96 | 43 | 139 | Comparative example |

According to Table C-4, the influence of the amount of the graphite powder (the amount of C in the overall composition) was investigated. In the sample No. C18 in which the amount of the graphite powder was less than 0.5%, the wear amount of the valve sheet was large because Fe matrix of the sintered alloy was not sufficiently strengthened. However, in the sample No. C19 in which the amount of the graphite powder was 0.5%, the wear amount of the valve sheet was remarkably decreased because Fe matrix of the sintered alloy was strengthened. When the amount of the graphite powder was not more than 1.0%, the wear amount of the valve sheet was decreased according to the increase in the amount of the graphite powder. In the sample in which the amount of the graphite powder was 1.2 to 1.5%, the wear amount of the valve sheet was increased and the wear amount of the valve was slightly increased because Fe matrix of the sintered alloy was hardened and embrittled. In this case, the total of the wear amounts was not a problem in practical use. On the other hand, in the sample No. C23 in which the amount of the graphite powder was greater than 1.5%, this tendency was more remarkable, and therefore the wear amount of the valve sheet was remarkably increased. Moreover, the wear amount of the valve was also remarkably increased because the wear particles of the valve sheet eroded the valve. According to the above results, when the amount of the graphite powder (the amount of C in the overall composition) was 0.5 to 1.5%, the wear amounts of the valve sheet and the valve were small.

Example C-5

The iron alloy powder (Fe-3% Cr powder) used in the example C-1, a graphite powder, and a hard phase forming alloy powder as shown in Table C-5 were prepared. The hard phase forming alloy powder has a composition in which a ratio of Co and Fe was different from that of the hard phase forming alloy powder (Co-30% Cr-20% Mo-17% Fe-3% Si powder) used in the sample No. C04 in the example C-1. The iron alloy powder, 35% of the hard phase forming alloy powder, and 1% of the graphite powder were added and were mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. C24 to C29 were formed. The wear tests were performed in the same way as in the example C-1 for these samples. The results are shown in Table C-5 with the values of the sample No. C04 in the example C-1.

TABLE C-5

| | Mixing ratio mass % | | | | | | | | | | | | |
|---|---|---|---|---|---|---|---|---|---|---|---|---|---|
| | | Hard phase forming alloy powder | | | | | | | | Evaluation item | | | |
| | | | | | | | | Substitutional | | Wear amount μm | | | |
| Sample | Iron alloy | | Compositions mass % | | | | | ratio | Graphite | Valve | | | |
| No. | powder | | Co | Fe | Cr | Mo | Si | of Fe | powder | sheet | Valve | Total | Notes |
| C24 | Balance | 35.00 | Balance | 0.00 | 30.00 | 20.00 | 3.00 | 0.00 | 1.00 | 18 | 3 | 21 | Comparative example |
| C25 | Balance | 35.00 | Balance | 7.00 | 30.00 | 20.00 | 3.00 | 14.90 | 1.00 | 22 | 4 | 26 | Practical example |
| C04 | Balance | 35.00 | Balance | 17.00 | 30.00 | 20.00 | 3.00 | 36.20 | 1.00 | 26 | 4 | 30 | Practical example |
| C26 | Balance | 35.00 | Balance | 28.00 | 30.00 | 20.00 | 3.00 | 59.60 | 1.00 | 29 | 4 | 33 | Practical example |
| C27 | Balance | 35.00 | Balance | 37.50 | 30.00 | 20.00 | 3.00 | 79.80 | 1.00 | 46 | 5 | 51 | Practical example |
| C28 | Balance | 35.00 | Balance | 42.00 | 30.00 | 20.00 | 3.00 | 89.40 | 1.00 | 86 | 6 | 92 | Practical example |
| C29 | Balance | 35.00 | Balance | 47.00 | 30.00 | 20.00 | 3.00 | 100.00 | 1.00 | 123 | 11 | 134 | Comparative example |

According to Table C-5, when Co in the hard phase forming alloy powder as substituted by Fe, the influence of the substitutional ratio of Fe was investigated. In the sample No. C24 in which Co in the hard phase forming alloy powder was not substituted by Fe, the wear amounts were the least among the above examples C, and wear resistance was good. When Co in the hard phase forming alloy powder was substituted by Fe and the substitutional ratio of Fe was increased, the wear amounts were increased. In this case, when the substitutional ratio of Fe was not more than 80% (samples Nos. C04 and C25 to C27), the wear amounts were not problem in practical use. However, in the samples Nos. C28 and C29 in which the substitutional ratio of Fe was more than 80%, the wear amounts were remarkably increased because the effect of Co was insufficient. According to the above results, although Co in the hard phase forming alloy powder could be substituted by Fe, the substitutional ratio of Fe should be not more than 80%. Furthermore, the substitutional ratio of Fe was preferably not more than 60%.

Example C-6

The iron alloy powder (Fe-3% Cr powder) used in the example C-1, a graphite powder, and a hard phase forming alloy powder as shown in Table C-6 were prepared. The hard phase forming alloy powder was formed by adding different amount of Mn in the hard phase forming alloy powder (Co-30% Cr-20% Mo-17% Fe-3% Si powder) used in the sample No. C04 in the example C-1. The iron alloy powder, 35% of the hard phase forming alloy powder, and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. C30 to C33 were formed. The wear tests were performed in the same way as in the example C-1 for these samples. The results are shown in Table C-6 with the values of the sample No. C04 in the example C-1.

TABLE C-6

| Sample No. | Mixing ratio mass % Iron alloy powder | Hard phase forming alloy powder | Compositions mass % Co | Fe | Cr | Mo | Si | Mn | Graphite powder | Evaluation item Wear amount μm Valve sheet | Valve | Total | Notes |
|---|---|---|---|---|---|---|---|---|---|---|---|---|---|
| C04 | Balance | 35.00 | Balance | 17.00 | 30.00 | 20.00 | 3.00 | — | 1.00 | 26 | 4 | 30 | Practical example |
| C30 | Balance | 35.00 | Balance | 17.00 | 30.00 | 20.00 | 3.00 | 1.00 | 1.00 | 23 | 5 | 28 | Practical example |
| C31 | Balance | 35.00 | Balance | 17.00 | 30.00 | 20.00 | 3.00 | 3.00 | 1.00 | 20 | 5 | 25 | Practical example |
| C32 | Balance | 35.00 | Balance | 17.00 | 30.00 | 20.00 | 3.00 | 5.00 | 1.00 | 24 | 11 | 35 | Practical example |
| C33 | Balance | 35.00 | Balance | 17.00 | 30.00 | 20.00 | 3.00 | 7.00 | 1.00 | 46 | 49 | 95 | Comparative example |

According to Table C-6, the effect of Mn added in the hard phase forming alloy powder (the hard phase) was investigated. In the samples Nos. C30 to C32 in which the amount of Mn in the hard phase forming alloy powder was not more than 5%, the alloy matrix of the hard phase was strengthened by Mn, whereby the wear amounts of the valve sheets were less than that of the sample No. C04 in which Mn in the hard phase forming alloy powder was not added. On the other hand, the wear amounts of the valves were slightly increased according to the increase in the amount of Mn, because the hard phase was strengthened. In the sample No. C33 in which the amount of Mn in the hard phase forming alloy powder was greater than 5%, the hard phase forming alloy powder was hardened, whereby compressibility of the raw powder was decreased. Therefore, the wear amount of the valve sheet was remarkably increased, and the wear amount of the valve was also remarkably increased because the wear particles of the valve sheet eroded the valve. According to the above results, although wear resistance of the sintered alloy could be further improved by adding Mn in the hard phase forming alloy powder, the amount of Mn in the hard phase forming alloy powder should be not more than 5%.

Example C-7

An iron alloy powder having a composition shown in Table C-7, the hard phase forming alloy powder (Co-30% Cr-20% Mo-17% Fe-3% Si powder) used in the sample No. C04 in the example C-1, and a graphite powder were prepared. The iron alloy powder was formed by adding at least one of Mo, V, and Nb in the iron alloy powder (Fe-3% Cr powder) used in the example C-1. The iron alloy powder, 35% of the hard phase forming alloy powder, and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. C34 to C44 were formed. The wear tests were performed in the same way as in the example C-1 for these samples. The results are shown in Table C-7 with the values of the sample No. C04 in the example C-1.

TABLE C-7

| Sample No. | Mixing ratio mass % Iron alloy powder | Compositions mass % Fe | Cr | Mo | V | Nb | Hard phase forming alloy powder | Graphite powder | Evaluation item Wear amount μm Valve sheet | Valve | Total | Notes |
|---|---|---|---|---|---|---|---|---|---|---|---|---|
| C04 | Balance | Balance | 3.00 | — | — | — | 35.00 | 1.00 | 26 | 4 | 30 | Practical example |
| C34 | Balance | Balance | 3.00 | 0.50 | — | — | 35.00 | 1.00 | 22 | 5 | 27 | Practical example |
| C35 | Balance | Balance | 3.00 | 0.50 | 0.50 | — | 35.00 | 1.00 | 18 | 7 | 25 | Practical example |
| C36 | Balance | Balance | 3.00 | 0.50 | — | 0.50 | 35.00 | 1.00 | 19 | 6 | 25 | Practical example |
| C37 | Balance | Balance | 3.00 | 0.50 | 0.50 | 0.50 | 35.00 | 1.00 | 15 | 11 | 26 | Practical example |
| C38 | Balance | Balance | 3.00 | 1.00 | — | — | 35.00 | 1.00 | 18 | 7 | 25 | Practical example |
| C39 | Balance | Balance | 3.00 | 1.50 | — | — | 35.00 | 1.00 | 14 | 10 | 24 | Practical example |
| C40 | Balance | Balance | 3.00 | 2.00 | — | — | 35.00 | 1.00 | 13 | 15 | 28 | Practical example |
| C41 | Balance | Balance | 3.00 | 1.50 | 0.50 | — | 35.00 | 1.00 | 13 | 13 | 26 | Practical example |

TABLE C-7-continued

| Sample No. | Mixing ratio mass % Iron alloy powder Compositions mass % Fe | Cr | Mo | V | Nb | Hard phase forming alloy powder | Graphite powder | Evaluation item Wear amount μm Valve sheet | Valve | Total | Notes |
|---|---|---|---|---|---|---|---|---|---|---|---|
| C42 | Balance Balance | 3.00 | 2.00 | 1.00 | — | 35.00 | 1.00 | 18 | 21 | 39 | Comparative example |
| C43 | Balance Balance | 3.00 | 2.40 | — | — | 35.00 | 1.00 | 13 | 15 | 28 | Practical example |
| C44 | Balance Balance | 3.00 | 3.00 | — | — | 35.00 | 1.00 | 16 | 25 | 41 | Comparative example |

According to samples Nos. C04, C34, C38 to C40, C43, and C44 in Table C-7, the effect of the amount of Mo in the iron alloy powder was investigated. In these samples, compared with the sample No. C04 in which Mo was not added in the iron alloy powder, when Mo was added in the iron alloy powder and the amount of Mo was increased, the wear amounts of the valves were slightly increased, but the wear amounts of valve sheets were decreased and the totals of the wear amounts were decreased. However, in the sample No. C44 in which the amount of Mo in the iron alloy powder was greater than 2.4%, the wear amount of the valve sheet was increased and the total of the wear amounts was increased.

The sample No. C38 included Mo in the iron alloy powder at 1%, and the sample No. C35 included Mo in the iron alloy powder at 0.5% and included V in the iron alloy powder at 0.5% (the total amount of Mo and V was 1.0%). The sample No. C36 included Mo in the iron alloy powder at 0.5% and included Nb in the iron alloy powder at 0.5% (the total amount of Mo and Nb was 1.0%). In these samples Nos. C38, C35, and C36, the wear amounts of the valve sheets were approximately equal and the wear amounts of the valves were approximately equal. The sample No. C39 included Mo in the iron alloy powder at 1.5%, and the sample No. C37 included Mo, V, and Nb in the iron alloy powder at respectively 0.5% (the total amount of Mo, V, and Nb was 1.5%). In these samples Nos. C39 and C37, the wear amounts of the valve sheets were approximately equal and the wear amounts of the valves were approximately equal. The sample No. C42 included Mo in the iron alloy powder at 2.0%, and the sample No. C41 included Mo in the iron alloy powder at 1.5% and included V in the iron alloy powder at 0.5% (the total amount of Mo and V was 2.0%). In these samples Nos. C42 and C41, the wear amounts of the valve sheets were approximately equal and the wear amounts of the valves were approximately equal. The sample No. C44 included Mo in the iron alloy powder at 3.0%, and the sample No. C42 included Mo in the iron alloy powder at 2.0% and included V in the iron alloy powder at 1.0% (the total amount of Mo and V was 3.0%). In these samples Nos. C44 and C42, the wear amounts of valve sheets were approximately equal, the wear amounts of valves were approximately equal, and the totals of the wear amounts were increased. Accordingly, Mo, V, and Nb in the iron alloy powder had approximately equal effects, and the wear resistance was improved when the total amount of Mo, V, and Nb in the iron alloy powder was not more than 2.4%.

Example C-8

The iron alloy powder (Fe-3% Cr powder) used in the example C-1, the hard phase forming alloy powder (Co-30% Cr-20% Mo-17% Fe-3% Si powder) used in the sample No. C04 in the example C-1, a graphite powder, and a nickel powder were prepared. The iron alloy powder, 35% of the hard phase forming alloy powder, 1% of the graphite powder, and a ratio shown in Table C-8 of the nickel powder ere added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. C45 to C50 were formed. The wear tests were performed in the same way as in the example C-1 for these samples. The results are shown in Table C-8 with the values of the sample No. C04 in the example C-1.

TABLE C-8

| Sample No. | Mixing ratio mass % Iron alloy powder | Hard phase forming alloy powder | Graphite powder | Nickel powder | Evaluation item Wear amount μm Valve sheet | Valve | Total | Notes |
|---|---|---|---|---|---|---|---|---|
| C04 | Balance | 35.00 | 1.00 | 0.00 | 26 | 4 | 30 | Practical example |
| C45 | Balance | 35.00 | 1.00 | 1.00 | 23 | 4 | 27 | Practical example |
| C46 | Balance | 35.00 | 1.00 | 2.00 | 22 | 4 | 26 | Practical example |
| C47 | Balance | 35.00 | 1.00 | 3.00 | 21 | 4 | 25 | Practical example |

TABLE C-8-continued

| | Mixing ratio mass % | | | | Evaluation item Wear amount μm | | | |
|---|---|---|---|---|---|---|---|---|
| Sample No. | Iron alloy powder | Hard phase forming alloy powder | Graphite powder | Nickel powder | Valve sheet | Valve | Total | Notes |
| C48 | Balance | 35.00 | 1.00 | 4.00 | 22 | 4 | 26 | Practical example |
| C49 | Balance | 35.00 | 1.00 | 5.00 | 25 | 5 | 30 | Practical example |
| C50 | Balance | 35.00 | 1.00 | 7.00 | 67 | 8 | 75 | Comparative example |

According to Table C-8, compared with the sample No. C04 in which the nickel powder was not added to the raw powder and Ni was not added in the matrix, in the samples Nos. C45 to C49, in which the nickel powder was added at not more than 5%, the wear amounts of the valve sheets were decreased and the totals of the wear amounts were decreased. In the sample No. C50 in which the amount of the nickel powder was greater than 5%, a large amount of Ni-rich austenite having low wear resistance was formed and remained in the matrix, whereby the wear resistance of the valve sheet was decreased and the wear amount of the valve sheet was increased. Moreover, the amount of hard martensite was increased, and the degree of erosion of the valve (the mating material) was increased, whereby the wear amount of the valve was increased and the total of the wear amounts was remarkably increased. Accordingly, although wear resistance was improved by adding the nickel powder, the amount of the nickel powder should be not more than 5.0%.

Example D

Fe—Co—C Alloy Matrix

Example D-1

An iron alloy powder consisting of 6.5% of Co, 1.5% of Ni, 1.5% of Mo, and the balance of Fe and inevitable impurities, a hard phase forming alloy powder having a composition shown in Table D-1, and a graphite powder were prepared. The iron alloy powder, 35% of the hard phase forming alloy powder, and 1% of the graphite powder ere added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. D01 to D06 were formed. The simple wear tests and the corrosion tests were performed in the same way as in the example C-1 for these samples. The results of these tests are also shown in Table D-1.

TABLE D-1

| | Mixing ratio mass % | | | | | | | | Evaluation item | | | | |
|---|---|---|---|---|---|---|---|---|---|---|---|---|---|
| | | Hard phase forming alloy powder | | | | | | | Wear amount μm | | | Corrosion | |
| Sample | Iron alloy | Compositions mass % | | | | | Graphite | Valve | | | loss | |
| No. | powder | Co | Fe | Cr | Mo | Si | powder | sheet | Valve | Total | mg/cm$^2$ | Notes |
| D01 | Balance | 35.00 | Balance | 42.00 | 5.00 | 20.00 | 3.00 | 1.00 | 74 | 2 | 76 | 0.30 | Comparative example |
| D02 | Balance | 35.00 | Balance | 37.00 | 10.00 | 20.00 | 3.00 | 1.00 | 45 | 2 | 47 | 0.16 | Practical example |
| D03 | Balance | 35.00 | Balance | 27.00 | 20.00 | 20.00 | 3.00 | 1.00 | 29 | 2 | 31 | 0.14 | Practical example |
| D04 | Balance | 35.00 | Balance | 17.00 | 30.00 | 20.00 | 3.00 | 1.00 | 21 | 2 | 23 | 0.11 | Practical example |
| D05 | Balance | 35.00 | Balance | 7.00 | 40.00 | 20.00 | 3.00 | 1.00 | 35 | 4 | 39 | 0.16 | Practical example |
| D06 | Balance | 35.00 | Balance | 2.00 | 45.00 | 20.00 | 3.00 | 1.00 | 69 | 20 | 89 | 0.26 | Comparative example |

According to Table D-1, the influence of the amount of Cr in the hard phase forming alloy powder (the amount of Cr in the hard phase) was investigated. In the sample No. D01, the amount of Cr in the hard phase forming alloy powder was insufficient, whereby the matrix of sintered alloy was not sufficiently strengthened, and the wear amount of the valve sheet was large. Moreover, since the amount of Cr was insufficient, the corrosion resistance was insufficient, and the corrosion loss was also large. In the sample No. D02 in which the amount of Cr in the hard phase forming alloy powder was 10%, the wear amount of the valve sheet was remarkably decreased because the matrix was strengthened by Cr. Moreover, the corrosion loss was reduced because corrosion resistance was improved. When the amount of Cr in the hard phase forming alloy powder was not more than 30%, the wear amounts of the valve sheets were at low levels and the corrosion losses were reduced according to the increase in amount of Cr. In the sample No. D05 in which the amount of Cr in the hard phase forming alloy powder was 40%, the hardness of the hard phase forming alloy powder was increased by the increase in the amount of Cr in the hard phase forming alloy powder, whereby compressibility of the raw powder was decreased, and the density of the green compact was decreased. As a result, the density of the sintered compact was decreased, whereby the wear amount of the valve sheet and the corrosion loss were increased, but these values were sufficiently small. Moreover, the wear amount of the valve was also increased because the wear particles of the valve sheet eroded the valve, but this value was small. However, in the sample No. D06 in which the amount of Cr in the hard phase forming alloy powder was greater than 40%, this tendency was more remarkable, and therefore the total of the wear amounts and the corrosion loss were remarkably increased. According to the above results, when the amount of Cr in the hard phase forming alloy powder (the amount of Cr in the hard phase) was 10 to 40%, the wear amounts of the valve sheet and the valve were small and the corrosion loss of the sintered alloy was small.

Example D-2

The iron alloy powder (Fe-6.5% Co-1.5% Ni-1.5% Mo powder) used in the example D-1, the hard phase forming alloy powder (Co-30% Cr-20% Mo-17% Fe-3% Si powder) used in the sample No. D04 in the example D-1, and a graphite powder were prepared. The ratio of the hard phase forming alloy powder were changed as shown in Table D-2, and these powders were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. D07 to D11 were formed. The wear tests and the corrosion tests were performed in the same way as in the example C-1 for these samples. The results are shown in Table D-2 with the values of the sample No. D04 in the example D-1.

TABLE D-2

| | Mixing ratio mass % | | | Evaluation item | | | | |
|---|---|---|---|---|---|---|---|---|
| | | Hard phase forming | | Wear amount μm | | | Corrosion | |
| Sample No. | Iron alloy powder | alloy powder | Graphite powder | Valve sheet | Valve | Total | loss mg/cm$^2$ | Notes |
| D07 | Balance | 5.00 | 1.00 | 102 | 2 | 104 | 0.49 | Comparative example |
| D08 | Balance | 15.00 | 1.00 | 46 | 1 | 47 | 0.22 | Practical example |
| D09 | Balance | 25.00 | 1.00 | 25 | 2 | 27 | 0.16 | Practical example |
| D04 | Balance | 35.00 | 1.00 | 21 | 2 | 23 | 0.11 | Practical example |
| D10 | Balance | 45.00 | 1.00 | 38 | 5 | 43 | 0.14 | Practical example |
| D11 | Balance | 55.00 | 1.00 | 73 | 34 | 107 | 0.24 | Comparative example |

According to Table D-2, the influence of the amount of the hard phase forming alloy powder (the amount of the hard phase dispersed in the matrix) was investigated. In the sample No. D07 in which the amount of the hard phase forming alloy powder was less than 15%, the wear amount of the valve sheet was large because the amount of the hard phase was insufficient and the plastic flow of the matrix could not be prevented. Moreover, the hard phase was insufficient, and Cr was not sufficiently dispersed from the hard phase to the matrix, whereby the corrosion loss was large. In the sample No. D08 in which the amount of the hard phase forming alloy powder was 15%, wear resistance and corrosion resistance of the matrix of the sintered alloy were improved by the hard phase, and the wear amount of the valve sheet was remarkably decreased and the corrosion loss was decreased. When the amount of the hard phase forming alloy powder was not more than 35%, the wear amount of the valve sheet and the corrosion loss were decreased according to the increase in the amount of the hard phase forming alloy powder. In the sample No. D10 in which the amount of the hard phase forming alloy powder was 45%, compressibility of the raw powder was decreased by the increase in the amount of the hard phase forming alloy powder, whereby the wear amount of the valve sheet and the corrosion loss were slightly increased, but these were at low levels. On the other hand, in the sample No. D11 in which the amount of the hard phase forming alloy powder was greater than 45%, the influence of the decrease of compressibility was remarkable, whereby the wear amount of the valve sheet was remarkably increased, and the corrosion loss was increased. Moreover, the wear amount of the valve was also remarkably increased because the wear particles of the valve sheet eroded the valve. According to the above results, when the amount of the hard phase forming alloy powder (the amount of the hard phase dispersed in the matrix) was 15 to 45%, the wear amounts of the valve sheet and the valve were small.

Example D-3

An iron alloy powder as shown in Table D-3, a graphite powder, and the hard phase forming alloy powder (Co-30% Cr-20% Mo-17% Fe-3% Si powder) used in the sample No. D04 in the example D-1 were prepared. In the iron alloy powder, the amount of Co was different from that of the iron alloy powder used in the example D-1. The iron alloy powder, 35% of the hard phase forming alloy powder, and 1% of the graphite powder were added and mixed. Furthermore, 0.8 mass parts of zinc stearate as a forming lubricant was added and mixed with 100 mass parts of the mixed powder. The obtained raw powder was compacted and sintered in the same way as in the example A-1, and samples Nos. D12 to D16 were formed. The wear tests and the corrosion tests were performed in the same way as in the example C-1 for these samples. The results are shown in Table D-3 with the values of the sample No. D04 in the example D-1.

TABLE D-3

| Sample No. | Mixing ratio mass % | | | | | | | Evaluation item | | | | |
|---|---|---|---|---|---|---|---|---|---|---|---|---|
| | Iron alloy powder compositions mass % | | | | | Hard phase forming alloy powder | Graphite powder | Wear amount μm | | | Corrosion loss mg/cm$^2$ | Notes |
| | | Fe | Co | Ni | Mo | | | Valve sheet | Valve | Total | | |
| D12 | Balance | Balance | 1.00 | 1.50 | 1.50 | 35.00 | 1.00 | 89 | 1 | 90 | 0.17 | Comparative example |
| D13 | Balance | Balance | 3.00 | 1.50 | 1.50 | 35.00 | 1.00 | 42 | 2 | 44 | 0.15 | Practical example |
| D14 | Balance | Balance | 5.00 | 1.50 | 1.50 | 35.00 | 1.00 | 30 | 2 | 32 | 0.11 | Practical example |
| D04 | Balance | Balance | 6.50 | 1.50 | 1.50 | 35.00 | 1.00 | 21 | 2 | 23 | 0.10 | Practical example |
| D15 | Balance | Balance | 8.00 | 1.50 | 1.50 | 35.00 | 1.00 | 23 | 2 | 25 | 0.12 | Practical example |
| D16 | Balance | Balance | 10.00 | 1.50 | 1.50 | 35.00 | 1.00 | 66 | 4 | 70 | 0.23 | Comparative example |

According to Table D-3, the influence of the amount of Co in the iron alloy powder was investigated. In the sample No. D12 in which the amount of Co was less than 3%, the wear amount of the valve sheet and the corrosion loss were large because strength and heat resistance of the Fe matrix were not sufficiently improved by Co. In the sample No. D13 in which the amount of Co in the iron alloy powder was 3%, the wear amount of the valve sheet was remarkably decreased because the Fe matrix was strengthened by Co and heat resistance was improved by Co, and the corrosion loss was decreased because corrosion resistance of the Fe matrix was improved. When the amount of Co in the iron alloy powder was not more than 6.5%, the wear amount of the valve sheet and the corrosion loss were decreased according to the increase in the amount of Co in the iron alloy powder. In the sample No. D15 in which the amount of Co in the iron alloy powder was 8%, compressibility of the raw powder was decreased by the increase in the hardness of the iron alloy powder, whereby the density of the green compact was decreased. As a result, the density of the sintered compact was decreased, whereby the wear amount of the valve sheet and the corrosion loss were slightly increased, but these were at low levels. On the other hand, in the sample No. D16 in which the amount of Co in the iron alloy powder was greater than 8%, the influence of the increase in the hardness of the iron alloy powder was remarkable, and the density of the sintered compact was remarkably decreased, whereby the wear amount of the valve sheet and the corrosion loss were remarkably increased. According to the above results, when the amount of Co in the iron alloy powder was 3 to 8%, the wear amount of the valve sheet was small and the corrosion loss was reduced.

Example D-4

The iron alloy powder (Fe-6.5% Co-1.5% Ni-1.5% Mo powder) used in the example D-1, the hard phase forming alloy powder (Co-30% Cr-20% Mo-17% Fe-3% Si powder) used in the sample No. D04 in the example D-1, and a graphite powder were prepared. The ratio of the graphite powder was changed as shown in Table D-4, and these powders were added and mixed. Furthermore, 0.8 mass parts of zinc stearate as a forming lubricant was added and mixed 100 mass parts of the mixed powder, and a raw powder was mixed. The obtained raw powder was compacted and sintered in the same way as in the example A-1, and samples Nos. D17 to D22 were formed. The wear tests were performed in the same way as in the example C-1 for these samples. The results are shown in Table D-4 with the values of the sample No. D04 in the example D-1.

TABLE D-4

| Sample No. | Mixing ratio mass % | | | Evaluation item Wear amount μm | | | |
|---|---|---|---|---|---|---|---|
| | Iron alloy powder | Hard phase forming alloy powder | Graphite powder | Valve sheet | Valve | Total | Notes |
| D17 | Balance | 35.00 | 0.30 | 121 | 2 | 123 | Comparative example |
| D18 | Balance | 35.00 | 0.50 | 55 | 2 | 57 | Practical example |
| D19 | Balance | 35.00 | 0.80 | 25 | 2 | 27 | Practical example |
| C04 | Balance | 35.00 | 1.00 | 21 | 2 | 23 | Practical example |
| D20 | Balance | 35.00 | 1.20 | 25 | 3 | 28 | Practical example |
| D21 | Balance | 35.00 | 1.50 | 48 | 7 | 55 | Practical example |
| D22 | Balance | 35.00 | 1.80 | 90 | 41 | 131 | Comparative example |

According to Table D-4, the influence of the amount of the graphite powder (the amount of C in the overall composition) was investigated. In the sample No. D17 in which the amount of the graphite powder was less than 0.5%, the wear amount of the valve sheet was large because Fe matrix of the sintered alloy was not sufficiently strengthened. In the sample No. D18 in which the amount of the graphite powder was 0.5%, the wear amount of the valve sheet was remarkably decreased because the Fe matrix of the sintered alloy was strengthened. When the amount of the graphite powder was not more than 1.0%, the wear amount of the valve sheet was decreased according to the increase in the amount of the graphite powder. In the sample in which the amount of the graphite powder was 1.2 to 1.5%, the wear amount of the valve sheet was increased and the wear amount of the valve was slightly increased because the Fe matrix of the sintered alloy was hardened and embrittled. In this case, the total of the wear amounts was not a problem in practical use. On the other hand, in the sample No. D22 in which the amount of the graphite powder was greater than 1.5%, this tendency was more remarkable, and therefore the wear amount of the valve sheet was remarkably increased. Moreover, the wear amount of the valve was also remarkably increased because the wear particles of the valve sheet eroded the valve. According to the above results, when the amount of the graphite powder (the amount of C in the overall composition) was 0.5 to 1.5%, the wear amounts of the valve sheet and the valve were small.

Example D-5

The iron alloy powder (Fe-6.5% Co-1.5% Ni-1.5% Mo powder) used in the example D-1, a graphite powder, and a hard phase forming alloy powder as shown in Table D-5 were prepared. The hard phase forming alloy powder had a composition in which a ratio of Co and Fe was different from that of the hard phase forming alloy powder (Co-30% Cr-20% Mo-17% Fe-3% Si powder) used in the sample No. D04 in the example D-1. The iron alloy powder, 35% of the hard phase forming alloy powder and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. D23 to D28 were formed. The wear tests were performed in the same way as in the example C-1 for these samples. The results are shown in Table D-5 with the values of the sample No. D04 in the example D-1.

TABLE D-5

| | Mixing ratio mass % | | | | | | | | | Evaluation item | | | |
|---|---|---|---|---|---|---|---|---|---|---|---|---|---|
| | | Hard phase forming alloy powder | | | | | | | | Wear amount μm | | | |
| Sample | Iron alloy | Compositions mass % | | | | | Substitutional | Graphite | Valve | | | | |
| No. | powder | Co | Fe | Cr | Mo | Si | ratio of Fe | powder | sheet | Valve | Total | Notes |
| D23 | Balance | 35.00 | Balance | 0.00 | 30.00 | 20.00 | 3.00 | 0.00 | 1.00 | 15 | 2 | 17 | Practical example |
| D24 | Balance | 35.00 | Balance | 7.00 | 30.00 | 20.00 | 3.00 | 14.90 | 1.00 | 18 | 2 | 20 | Practical example |
| D04 | Balance | 35.00 | Balance | 17.00 | 30.00 | 20.00 | 3.00 | 36.20 | 1.00 | 21 | 2 | 23 | Practical example |
| D25 | Balance | 35.00 | Balance | 28.00 | 30.00 | 20.00 | 3.00 | 59.60 | 1.00 | 24 | 2 | 26 | Practical example |
| D26 | Balance | 35.00 | Balance | 37.50 | 30.00 | 20.00 | 3.00 | 79.80 | 1.00 | 40 | 3 | 43 | Practical example |
| D27 | Balance | 35.00 | Balance | 42.00 | 30.00 | 20.00 | 3.00 | 89.40 | 1.00 | 71 | 4 | 75 | Practical example |
| D28 | Balance | 35.00 | Balance | 47.00 | 30.00 | 20.00 | 3.00 | 100.00 | 1.00 | 102 | 9 | 111 | Comparative example |

According to Table D-5, when Co in the hard phase forming alloy powder was substituted by Fe, the influence of the substitutional ratio of Fe was investigated. In the sample No. D23 in which Co in the hard phase forming alloy powder was not substituted by Fe, the wear amounts were the least among the above examples D and wear resistance was good. When Co in the hard phase forming alloy powder was substituted by Fe and the substitutional ratio of Fe was increased, the wear amounts were increased. In this case, when the substitutional ratio of Fe was not more than 80% (samples Nos. D04 and D24 to D26), the wear amounts were not a problem in practical use. However, in the samples Nos. D27 and D28 in which the substitutional ratio of Fe was more than 80%, the wear amounts were remarkably increased, because the effect of Co was insufficient. According to the above results, although Co in the hard phase forming alloy powder could be substituted by Fe, the substitutional ratio of Fe should be not more than 80%. The substitutional ratio of Fe is preferably not more than 60%.

Example D-6

The iron alloy powder (Fe-6.5% Co-1.5% Ni-1.5% Mo powder) used in the example D-1, a graphite powder, and a hard phase forming alloy powder as shown in Table D-6 were prepared. The hard phase forming alloy powder was formed by adding different amount of Mn in the hard phase forming alloy powder (Co-30% Cr-20% Mo-17% Fe-3% Si powder) used in the sample No. D04 in the example D-1. The iron alloy powder, 35% of the hard phase forming alloy powder and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. D29 to D32 were formed. The wear tests were performed in the same way as in the example C-1 for these samples. The results are shown in Table D-6 with the values of the sample No. D04 in the example D-1.

TABLE D-6

| Sample No. | Iron alloy powder | Mixing ratio mass % | | | | | | | | Evaluation item Wear amount μm | | | |
|---|---|---|---|---|---|---|---|---|---|---|---|---|---|
| | | Hard phase forming alloy powder | | | | | | | | | | | |
| | | Compositions mass % | | | | | | Graphite powder | Valve sheet | Valve | Total | Notes |
| | | Co | Fe | Cr | Mo | Si | Mn | | | | | |
| D04 | Balance | 35.00 | Balance | 17.00 | 30.00 | 20.00 | 3.00 | — | 1.00 | 21 | 2 | 23 | Practical example |
| D29 | Balance | 35.00 | Balance | 17.00 | 30.00 | 20.00 | 3.00 | 1.00 | 1.00 | 19 | 2 | 21 | Practical example |
| D30 | Balance | 35.00 | Balance | 17.00 | 30.00 | 20.00 | 3.00 | 3.00 | 1.00 | 16 | 3 | 19 | Practical example |
| D31 | Balance | 35.00 | Balance | 17.00 | 30.00 | 20.00 | 3.00 | 5.00 | 1.00 | 20 | 9 | 29 | Practical example |
| D32 | Balance | 35.00 | Balance | 17.00 | 30.00 | 20.00 | 3.00 | 7.00 | 1.00 | 38 | 45 | 83 | Comparative example |

According to Table D-6, the effect of Mn added in the hard phase forming alloy powder (the hard phase) was investigated. In the samples Nos. D29 to D31 in which the amount of Mn in the hard phase forming alloy powder was not more than 5%, the alloy matrix of the hard phase was strengthened by Mn, whereby the wear amounts of valve sheets were less than that of the sample No. D04 in which Mn in the hard phase forming alloy powder was not added. On the other hand, the wear amounts of the valves were slightly increased according to the increase in the amount of Mn, because the hard phase was strengthened. In the sample No. D32 in which the amount of Mn in the hard phase forming alloy powder was greater than 5%, the hard phase forming alloy powder was hardened, and compressibility of the raw powder was remarkably decreased, whereby the wear amount of the valve sheet was remarkably increased. Moreover, the wear amount of the valve was also remarkably increased because the wear particles of the valve sheet eroded the valve. According to the above results, although wear resistance could be further improved by adding Mn in the hard phase forming alloy powder, the amount of Mn in the hard phase forming alloy powder should be not more than 5%.

Example D-7

The iron alloy powder (Fe-6.5% Co-1.5 Ni-1.5% Mo powder) used in the example D-1, the hard phase forming alloy powder (Co-30% Cr-20% Mo-17% Fe-3% Si powder) used in the sample No. D04 in the example D-1, a graphite powder, and a nickel powder were prepared. The iron alloy powder, 35% of the hard phase forming alloy powder, 1% of the graphite powder, and a ratio shown in Table D-7 of the nickel powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. D33 to D39 were formed. The wear tests were performed in the same way as in the example C-1 for these samples. The results are shown in Table D-7 with the values of the sample No. D04 in the example D-1.

TABLE D-7

| Sample No. | Iron alloy powder | Mixing ratio mass % | | | Evaluation item Wear amount μm | | | Notes |
|---|---|---|---|---|---|---|---|---|
| | | Hard phase forming alloy powder | Graphite powder | Nickel powder | Valve sheet | Valve | Total | |
| D04 | Balance | 35.00 | 1.00 | 0.00 | 21 | 2 | 23 | Practical example |
| D33 | Balance | 35.00 | 1.00 | 0.10 | 20 | 2 | 22 | Practical example |
| D34 | Balance | 35.00 | 1.00 | 1.00 | 18 | 2 | 20 | Practical example |
| D35 | Balance | 35.00 | 1.00 | 2.00 | 16 | 2 | 18 | Practical example |
| D36 | Balance | 35.00 | 1.00 | 3.00 | 17 | 2 | 19 | Practical example |
| D37 | Balance | 35.00 | 1.00 | 4.00 | 18 | 2 | 20 | Practical example |
| D38 | Balance | 35.00 | 1.00 | 5.00 | 20 | 3 | 23 | Practical example |
| D39 | Balance | 35.00 | 1.00 | 7.00 | 49 | 8 | 57 | Comparative example |

According to Table D-7, compared with the sample No. D04 in which the nickel powder was not added to the raw powder and Ni was not added in the matrix, in the samples Nos. D33 to D38 in which the nickel powder was added at not more than 5%, the wear amount of the valve sheet was decreased and the total of the wear amounts was decreased. In the sample No. D39 in which the amount of the nickel powder was greater than 5%, a large amount of Ni-rich austenite having low wear resistance was formed and remained in the matrix, whereby wear resistance of the valve sheet was decreased and the wear amount of the valve sheet was increased. Moreover, the amount of the hard martensite was increased, and the erosion of the valve (the mating material) was increased, whereby the wear amount of the valve was increased and the total of the wear amounts was remarkably increased. Accordingly, although wear resistance was improved by adding the nickel powder, the amount of the nickel powder should be not more than 5.0%.

Example E

Fe—Ni—Mo—C Alloy Matrix

Example E-1

An iron alloy powder consisting of 2% of Ni, 1% of Mo, 0.5% of Cr, 0.3% of Mn, and the balance of Fe and inevitable impurities, a hard phase forming alloy powder shown in Table E-1, and a graphite powder were prepared. The iron alloy powder, 35% of the hard phase forming alloy powder, and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. E01 to E06 were formed. The simple wear tests and the corrosion tests were performed in the same way as in the example C-1 for these samples. The results of these tests are also shown in Table E-1.

TABLE E-1

| | Mixing ratio mass % | | | | | | | | Evaluation item | | | | |
|---|---|---|---|---|---|---|---|---|---|---|---|---|---|
| | | Hard phase forming alloy powder | | | | | | | Wear amount μm | | | Corrosion | |
| Sample | Iron alloy | Compositions mass % | | | | | Graphite | Valve | | | | loss | |
| No. | powder | Co | Fe | Cr | Mo | Si | powder | sheet | Valve | Total | mg/cm$^2$ | | Notes |
| E01 | Balance | 35.00 | Balance | 42.00 | 5.00 | 20.00 | 3.00 | 1.00 | 92 | 4 | 96 | 0.31 | Comparative example |
| E02 | Balance | 35.00 | Balance | 37.00 | 10.00 | 20.00 | 3.00 | 1.00 | 55 | 4 | 59 | 0.15 | Practical example |
| E03 | Balance | 35.00 | Balance | 27.00 | 20.00 | 20.00 | 3.00 | 1.00 | 37 | 4 | 41 | 0.14 | Practical example |
| E04 | Balance | 35.00 | Balance | 17.00 | 30.00 | 20.00 | 3.00 | 1.00 | 27 | 4 | 31 | 0.11 | Practical example |
| E05 | Balance | 35.00 | Balance | 7.00 | 40.00 | 20.00 | 3.00 | 1.00 | 42 | 7 | 49 | 0.15 | Practical example |
| E06 | Balance | 35.00 | Balance | 2.00 | 45.00 | 20.00 | 3.00 | 1.00 | 79 | 24 | 103 | 0.32 | Comparative example |

According to Table E-1, the influence of the amount of Cr in the hard phase forming alloy powder (the amount of Cr in the hard phase) was investigated. In the sample No. E01, the amount of Cr in the hard phase forming alloy powder was insufficient, whereby the matrix of sintered alloy was not sufficiently strengthened, and the wear amount of the valve sheet was large. Moreover, since the amount of Cr was insufficient, corrosion resistance was insufficient, and the corrosion loss was also large. In the sample No. E02 in which the amount of Cr in the hard phase forming alloy powder was 10%, the wear amount of the valve sheet was remarkably decreased because the matrix was strengthened by Cr. Moreover, the corrosion loss was reduced because corrosion resistance was improved by Cr. When the amount of Cr in the hard phase forming alloy powder was not more than 30%, the wear amounts of the valve sheets were low values and the corrosion losses were reduced according to the increase in the amount of Cr. In the sample No. E05 in which the amount of Cr in the hard phase forming alloy powder was 40%, the hardness of the hard phase forming alloy powder was increased by the increase in the amount of Cr in the hard phase forming alloy powder, whereby compressibility of the raw powder was decreased, and the density of the green compact was decreased. As a result, the density of the sintered compact was decreased, whereby the wear amount of the valve sheet and the corrosion loss were increased, but these values were sufficiently small. Moreover, the wear amount of the valve was also increased because the wear particles of the valve sheet eroded the valve, but this value was small. However, in the sample No. E06 in which the amount of Cr in the hard phase forming alloy powder was greater than 40%, this tendency was more remarkable, and therefore the total of the wear amounts and the corrosion loss were remarkably increased. According to the above results, when the amount of Cr in the hard phase forming alloy powder was 10 to 40%, the wear amounts of the valve sheet and the valve were small and the corrosion losses of the sintered alloys were small.

Example E-2

The iron alloy powder (Fe-2% Ni-1% Mo-0.5% Cr-0.3% Mn powder) used in the example E-1, the hard phase forming alloy powder (Co-30% Cr-20% Mo-17% Fe-3% Si powder) used in the sample No. E04 in the example E-1, and a graphite powder were prepared. The ratio of the hard phase forming alloy powder was changed as shown in Table E-2, and these powders were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. E07 to E11 were formed. The wear tests and the corrosion tests were performed in the same way as in the example C-1 for these samples. The results are shown in Table E-2 with the values of the sample No. E04 in the example E-1.

TABLE E-2

| Sample No. | Mixing ratio mass % Iron alloy powder | Hard phase forming alloy powder | Graphite powder | Evaluation item Wear amount μm Valve sheet | Valve | Total | Corrosion loss mg/cm$^2$ | Notes |
|---|---|---|---|---|---|---|---|---|
| E07 | Balance | 5.00 | 1.00 | 110 | 2 | 112 | 0.51 | Comparative example |
| E08 | Balance | 15.00 | 1.00 | 53 | 3 | 56 | 0.26 | Practical example |
| E09 | Balance | 25.00 | 1.00 | 37 | 3 | 35 | 0.15 | Practical example |
| E10 | Balance | 35.00 | 1.00 | 27 | 4 | 31 | 0.11 | Practical example |
| E11 | Balance | 45.00 | 1.00 | 45 | 6 | 51 | 0.18 | Practical example |
| E12 | Balance | 55.00 | 1.00 | 86 | 45 | 131 | 0.45 | Comparative example |

According to Table E-2, the influence of the amount of the hard phase forming alloy powder (the amount of the hard phase dispersed in the matrix) was investigated. In the sample No. E07 in which the amount of the hard phase forming alloy powder was less than 15%, the wear amount of the valve sheet was large because the amount of the hard phase was insufficient and the plastic flow of the matrix could not be prevented. Moreover, the hard phase was insufficient, and Cr was not sufficiently dispersed from the hard phase to the matrix, whereby the corrosion loss was large. In the sample No. E08 in which the amount of the hard phase forming alloy powder was 15%, the wear amount of the valve sheet was remarkably decreased and the corrosion loss was decreased because wear resistance and corrosion resistance of the matrix of the sintered alloy are improved by the hard phase. When the amount of the hard phase forming alloy powder was not more than 35%, the wear amount of the valve sheet and the corrosion loss were decreased according to the increase in the amount of the hard phase forming alloy powder. In the sample No. E10 in which the amount of the hard phase forming alloy powder was 45%, compressibility of the raw powder was decreased by the increase in the amount of the hard phase forming alloy powder, whereby the wear amount of the valve sheet and the corrosion loss were slightly increased, but these were at low levels. On the other hand, in the sample No. E11 in which the amount of the hard phase forming alloy powder was greater than 45%, the influence of the decrease of compressibility was remarkable, whereby the wear amount of the valve sheet was remarkably increased and the corrosion loss was increased. Moreover, the wear amount of the valve was also remarkably increased because the wear particles of the valve sheet eroded the valve. According to the above results, when the amount of the hard phase forming alloy powder (the amount of the hard phase dispersed in the matrix) was 15 to 45%, the wear amounts of the valve sheet and the valve were small.

Example E-3

An iron alloy powder having a composition shown in Table E-3, the hard phase forming alloy powder (Co-30% Cr-20% Mo-17% Fe-3% Si powder) used in the sample No. E04 in the example E-1, and a graphite powder were prepared. The iron alloy powder, 35% of the hard phase forming alloy powder and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. E12 to E20 were formed. The wear tests and the corrosion tests were performed in the same way as in the example C-1 for these samples. The results are shown in Table E-3 with the values of the sample No. E04 in the example E-1.

TABLE E-3

| Sample No. | Mixing ratio mass % Iron alloy powder | Compositions mass % Fe | Ni | Cr | Mo | Mn | Hard phase forming alloy powder | Graphite powder | Evaluation item Wear amount μm Valve sheet | Valve | Total | Notes |
|---|---|---|---|---|---|---|---|---|---|---|---|---|
| E12 | Balance | Balance | 0.00 | 0.50 | 1.00 | 0.30 | 35.00 | 1.00 | 85 | 3 | 88 | Comparative example |
| E13 | Balance | Balance | 1.00 | 0.50 | 1.00 | 0.30 | 35.00 | 1.00 | 40 | 4 | 44 | Practical example |
| E04 | Balance | Balance | 2.00 | 0.50 | 1.00 | 0.30 | 35.00 | 1.00 | 27 | 4 | 31 | Practical example |
| E14 | Balance | Balance | 3.00 | 0.50 | 1.00 | 0.30 | 35.00 | 1.00 | 33 | 5 | 38 | Practical example |
| E15 | Balance | Balance | 5.00 | 0.50 | 1.00 | 0.30 | 35.00 | 1.00 | 59 | 13 | 72 | Comparative example |

TABLE E-3-continued

| Sample No. | Mixing ratio mass % | | | | | | | | Evaluation item Wear amount μm | | | Notes |
|---|---|---|---|---|---|---|---|---|---|---|---|---|
| | Iron alloy powder | | | | | | Hard phase forming alloy powder | Graphite powder | Valve sheet | Valve | Total | |
| | | Compositions mass % | | | | | | | | | | |
| | | Fe | Ni | Cr | Mo | Mn | | | | | | |
| E16 | Balance | Balance | 2.00 | 0.00 | 1.00 | 0.30 | 35.00 | 1.00 | 62 | 2 | 64 | Comparative example |
| E17 | Balance | Balance | 2.00 | 0.10 | 1.00 | 0.30 | 35.00 | 1.00 | 41 | 2 | 43 | Practical example |
| E18 | Balance | Balance | 2.00 | 0.30 | 1.00 | 0.30 | 35.00 | 1.00 | 31 | 3 | 34 | Practical example |
| E04 | Balance | Balance | 2.00 | 0.50 | 1.00 | 0.30 | 35.00 | 1.00 | 27 | 4 | 31 | Practical example |
| E19 | Balance | Balance | 2.00 | 1.00 | 1.00 | 0.30 | 35.00 | 1.00 | 35 | 5 | 40 | Practical example |
| E20 | Balance | Balance | 2.00 | 1.50 | 1.00 | 0.30 | 35.00 | 1.00 | 67 | 14 | 81 | Comparative example |

According to samples Nos. E04 and E12 to E15 in Table E-3, the influence of the amount of Ni in the iron alloy powder was investigated. In the sample No. E12 in which Ni was not added in the iron alloy powder, the wear amount of the valve sheet and the corrosion loss were large because the Fe matrix of the sintered alloy was not strengthened. In the samples Nos. E13 E04, and E14 in which the amount of Ni in the iron alloy powder was 1 to 3%, strength and corrosion resistance of the Fe matrix were improved by Ni, the wear amount of the valve sheet was remarkably decreased, and the corrosion loss was decreased. In the sample No. E15 in which the amount of Ni in the iron alloy powder was greater than 3%, compressibility of the raw powder was decreased by the increase in the hardness of the iron alloy powder, whereby the density of the compact was decreased. As a result, the density of the sintered compact was decreased, whereby the wear amount of the valve sheet and the corrosion loss were remarkably increased. According to the above results, when the amount of Ni in the iron alloy powder was 1 to 3%, the wear amount of the valve sheet was small and the corrosion loss was reduced.

According to samples Nos. E04 and E16 to E20 in Table E-3, the influence of the amount of Cr in the iron alloy powder was investigated. In the sample No. E16 in which Cr was not added in the iron alloy powder, the wear amount of the valve sheet and the corrosion loss were large because the Fe matrix of the sintered alloy was not strengthened. However, in the samples Nos. E18, E04, and E19 in which the amount of Cr in the iron alloy powder was 0.1 to 1%, strength and corrosion resistance of the Fe matrix were improved by Cr, whereby the wear amount of the valve sheet was remarkably decreased, and the corrosion loss was decreased. In the sample No. E20 in which the amount of Cr in the iron alloy powder was greater than 1%, compressibility of the raw powder was decreased by the increase in the hardness of the iron alloy powder, whereby the density of the green compact was decreased. As a result, the density of the sintered compact was decreased, whereby the wear amount of the valve sheet and the corrosion loss were remarkably increased. According to the above results, when the amount of Cr in the iron alloy powder was 0.1 to 1%, the wear amount of the valve sheet was small and the corrosion loss was reduced.

Example E-4

The iron alloy powder (Fe-2% Ni-1% Mo-0.5% Cr-0.3% Mn powder) used in the example E-1, the hard phase forming alloy powder (Co-30% Cr-20% Mo-17% Fe-3% Si powder) used in the sample No. E04 in the example E-1, and a graphite powder were prepared. The ratio of the graphite powder was changed as shown in Table E-4, and these powders were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. E21 to E26 were formed. The wear tests were performed in the same way as in the example C-1 for these samples. The results are shown in Table E-4 with the values of the sample No. E04 in the example E-1.

TABLE E-4

| Sample No. | Mixing ratio mass % | | | Evaluation item Wear amount μm | | | Notes |
|---|---|---|---|---|---|---|---|
| | Iron alloy powder | Hard phase forming alloy powder | Graphite powder | Valve sheet | Valve | Total | |
| E21 | Balance | 35.00 | 0.30 | 113 | 2 | 115 | Comparative example |
| E22 | Balance | 35.00 | 0.50 | 54 | 3 | 57 | Practical example |
| E23 | Balance | 35.00 | 0.80 | 32 | 4 | 36 | Practical example |
| E04 | Balance | 35.00 | 1.00 | 27 | 4 | 31 | Practical example |
| E24 | Balance | 35.00 | 1.20 | 32 | 5 | 37 | Practical example |
| E25 | Balance | 35.00 | 1.50 | 51 | 10 | 61 | Practical example |
| E26 | Balance | 35.00 | 1.80 | 102 | 52 | 154 | Comparative example |

According to Table E-4, the influence of the amount of the graphite powder (the amount of C in the overall composition) was investigated. In the sample No. E21 in which the amount of the graphite powder was less than 0.5%, the wear amount of the valve sheet was large because the Fe matrix of the sintered alloy was not sufficiently strengthened. In the sample No. E22 in which the amount of the graphite powder was 0.5%, the wear amount of the valve sheet was remarkably decreased because the Fe matrix of the sintered alloy was strengthened. When the amount of the graphite powder was not more than 1.0%, the wear amount of the valve sheet was decreased according to the increase in the amount of the graphite powder. In the samples in which the amount of the graphite powder was 1.0 to 1.5%, the Fe matrix of the sintered alloy was hardened and embrittled, whereby the wear amount of the valve sheet was increased and the wear amount of the valve was slightly increased. In this case, the total of the wear amounts was not a problem n practical use. On the other hand, in the sample No. E26 in which the amount of the graphite powder was greater than 1.5%, this tendency was more remarkable, and therefore the wear amount of the valve sheet was remarkably increased. Moreover, the wear amount of the valve was also remarkably increased because the wear particles of the valve sheet eroded the valve. According to the above results, when the amount of the graphite powder (the amount of C in the overall composition) was 0.5 to 1.5%, the wear amounts of the valve sheet and the valve were small.

Example E-5

The iron alloy powder (Fe-2% Ni-1% Mo-0.5% Cr-0.3% Mn powder) used in the example E-1, a graphite powder, and a hard phase forming alloy powder as shown in Table E-5 were prepared. The hard phase forming alloy powder had a composition in which a ratio of Co and Fe was different from that of the hard phase forming alloy powder (Co-30% Cr-20% Mo-17% Fe-3% Si powder) used in the sample No. E04 in the example E-1. The iron alloy powder, 35% of the hard phase forming alloy powder, and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. E27 to E32 were formed. The wear tests were performed in the same way as in the example C-1 for these samples. The results are shown in Table E-5 with the values of the sample No. E04 in the example E-1.

According to Table E-5, when Co in the hard phase forming alloy powder was substituted by Fe, the influence of the substitutional ratio of Fe was investigated. In the sample No. E27 in which Co in the hard phase forming alloy powder was not substituted by Fe, the wear amounts were the least among the above examples E and wear resistance was good. When Co in the hard phase forming alloy powder was substituted by Fe and the substitutional ratio of Fe was increased, the wear amounts were increased. In this case, when the substitutional ratio of Fe was not more than 80% (samples Nos. E04 and E28 to E30), the wear amounts were not a problem in practical use. However, in the samples Nos. E31 and E32 in which the substitutional ratio of Fe was more than 80%, the wear amounts were remarkably increased, because the effect of Co was insufficient. According to the above results, although Co in the hard phase forming alloy powder could be substituted by Fe, the substitutional ratio of Fe should be not more than 80%. Furthermore, the substitutional ratio of Fe was preferably not more than 60%.

Example E-6

The iron alloy powder (Fe-2% Ni-1% Mo-0.5% Cr-0.3% Mn powder) used in the example E-1, a graphite powder, and a hard phase forming alloy powder as shown in Table E-6 were prepared. The hard phase forming alloy powder was formed by adding different amount of Mn in the hard phase forming alloy powder (Co-30% Cr-20% Mo-17% Fe-3% Si powder) used in the sample No. E04 in the example E-1. The iron alloy powder, 35% of the hard phase forming alloy powder, and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. E33 to E36 were formed. The wear tests were performed in the same way as in the example C-1 for these samples. The results are shown in Table E-6 with the values of the sample No. E04 in the example E-1.

TABLE E-5

| | Mixing ratio mass % | | | | | | | | | | | | |
|---|---|---|---|---|---|---|---|---|---|---|---|---|---|
| | | Hard phase forming alloy powder | | | | | | | | Evaluation item | | | |
| | | | | | | | | Substitutional | | Wear amount μm | | | |
| Sample | Iron alloy | Compositions mass % | | | | | | ratio | Graphite | Valve | | | |
| No. | powder | Co | Fe | Cr | Mo | Si | | of Fe | powder | sheet | Valve | Total | Notes |
| E27 | Balance | 35.00 | Balance | 0.00 | 30.00 | 20.00 | 3.00 | 0.00 | 1.00 | 19 | 3 | 22 | Practical example |
| E28 | Balance | 35.00 | Balance | 7.00 | 30.00 | 20.00 | 3.00 | 14.90 | 1.00 | 23 | 3 | 26 | Practical example |
| E04 | Balance | 35.00 | Balance | 17.00 | 30.00 | 20.00 | 3.00 | 36.20 | 1.00 | 27 | 4 | 31 | Practical example |
| E29 | Balance | 35.00 | Balance | 28.00 | 30.00 | 20.00 | 3.00 | 59.60 | 1.00 | 31 | 4 | 35 | Practical example |
| E30 | Balance | 35.00 | Balance | 37.50 | 30.00 | 20.00 | 3.00 | 79.80 | 1.00 | 49 | 4 | 53 | Practical example |
| E31 | Balance | 35.00 | Balance | 42.00 | 30.00 | 20.00 | 3.00 | 89.40 | 1.00 | 88 | 6 | 94 | Practical example |
| E32 | Balance | 35.00 | Balance | 47.00 | 30.00 | 20.00 | 3.00 | 100.00 | 1.00 | 129 | 12 | 141 | Comparative example |

TABLE E-6

| Sample No. | Mixing ratio mass % | | | | | | | | | Evaluation item Wear amount μm | | | |
|---|---|---|---|---|---|---|---|---|---|---|---|---|---|
| | Iron alloy powder | Hard phase forming alloy powder Compositions mass % | | | | | | Graphite powder | Valve sheet | Valve | Total | Notes |
| | | Co | Fe | Cr | Mo | Si | Mn | | | | | |
| E04 | Balance | 35.00 | Balance | 17.00 | 30.00 | 20.00 | 3.00 | — | 1.00 | 27 | 4 | 31 | Practical example |
| E33 | Balance | 35.00 | Balance | 17.00 | 30.00 | 20.00 | 3.00 | 1.00 | 1.00 | 24 | 4 | 28 | Practical example |
| E34 | Balance | 35.00 | Balance | 17.00 | 30.00 | 20.00 | 3.00 | 3.00 | 1.00 | 22 | 5 | 27 | Practical example |
| E35 | Balance | 35.00 | Balance | 17.00 | 30.00 | 20.00 | 3.00 | 5.00 | 1.00 | 24 | 12 | 36 | Practical example |
| E36 | Balance | 35.00 | Balance | 17.00 | 30.00 | 20.00 | 3.00 | 7.00 | 1.00 | 47 | 50 | 97 | Comparative example |

According to Table E-6, the effect of Mn in the hard phase forming alloy powder (the hard phase) was investigated. In the samples Nos. D33 to D35 in which the amount of Mn in the hard phase forming alloy powder was not more than 5%, the alloy matrix of the hard phase was strengthened by Mn, whereby the wear amounts of the valve sheets were less than that of the sample No. E04 in which Mn was not added in the hard phase forming alloy powder. On the other hand, the wear amounts of the valves were slightly increased according to the increase in the amount of Mn, because the hard phase was strengthened. In the sample No. E36 in which the amount of Mn in the hard phase forming alloy powder was greater than 5%, the hard phase forming alloy powder was hardened, and compressibility of the raw powder was remarkably decreased, whereby the wear amount of the valve sheet was remarkably increased. Moreover, the wear amount of the valve was also remarkably increased because the wear particles of the valve sheet eroded the valve. According to the above results, although wear resistance could be further improved by adding Mn in the hard phase forming alloy powder, the amount of Mn in the hard phase forming alloy powder should be not more than 5%.

Example E-7

The iron alloy powder (Fe-2% Ni-1% Mo-0.5% Cr-0.3% Mn powder) used in the example E-1, the hard phase forming alloy powder (Co-30% Cr-20% Mo-17% Fe-3% Si powder) used in the sample No. E04 in the example E-1, a graphite powder, and a nickel powder were prepared. The iron alloy powder, 35% of the hard phase forming alloy powder, 1% of the graphite powder, and a ratio shown in Table E-7 of the nickel powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. E37 to E43 were formed. The wear tests were performed in the same way as in the example C-1 for these samples. The results are shown in Table E-7 with the values of the sample No. E04 in the example E-1.

TABLE E-7

| Sample No. | Mixing ratio mass % | | | | Evaluation item Wear amount μm | | | |
|---|---|---|---|---|---|---|---|---|
| | Iron alloy powder | Hard phase forming alloy powder | Graphite powder | Nickel powder | Valve sheet | Valve | Total | Notes |
| E04 | Balance | 35.00 | 1.00 | 0.00 | 27 | 4 | 31 | Practical example |
| E37 | Balance | 35.00 | 1.00 | 0.10 | 25 | 4 | 29 | Practical example |
| E38 | Balance | 35.00 | 1.00 | 1.00 | 24 | 4 | 28 | Practical example |
| E39 | Balance | 35.00 | 1.00 | 2.00 | 22 | 4 | 26 | Practical example |
| E40 | Balance | 35.00 | 1.00 | 3.00 | 21 | 4 | 25 | Practical example |
| E41 | Balance | 35.00 | 1.00 | 4.00 | 23 | 5 | 28 | Practical example |
| E42 | Balance | 35.00 | 1.00 | 5.00 | 25 | 6 | 31 | Practical example |
| E43 | Balance | 35.00 | 1.00 | 7.00 | 75 | 10 | 85 | Comparative example |

According to Table E-7, compared with the sample No. E04 in which the nickel powder was not added to the raw powder and Ni was not added in the matrix, in the samples Nos. E37 to E42 in which the nickel powder was added at not more than 5%, the wear amount of the valve sheet was decreased and the total of the wear amounts were decreased. In the sample No. E43 in which the amount of the nickel powder was greater than 5%, a large amount of Ni-rich austenite having low wear resistance was formed and remained in the matrix, whereby wear resistance of the valve sheet was decreased and the wear amount of the valve sheet was increased. Moreover, the amount of hard martensite was increased, and the erosion of the valve (the mating material) was increased, whereby the wear amount of the valve was increased and the total of the wear amount was remarkably increased. Accordingly, although wear resistance was improved by adding the nickel powder, the amount of the nickel powder should be not more than 5.0%.

Example E-8

The iron alloy powder (Fe-2% Ni-1 Mo-0.5% Cr-0.3% Mn powder) used in the example E-1, the hard phase forming alloy powder (Co-30% Cr-20% Mo-17% Fe-3% Si powder) used in the sample No. E04 in the example E-1, a graphite powder, and a copper powder were prepared. The iron alloy powder, 35% of the hard phase forming alloy powder, 1% of the graphite powder, and a ratio shown in Table E-8 of the copper powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. E44 to E50 were formed. The wear tests were performed in the same way as in the example C-1 for these samples. The results are shown in Table E-8 with the values of the sample No. E04 in the example E-1.

TABLE E-8

| | Mixing ratio mass % | | | | Evaluation item Wear amount μm | | | |
|---|---|---|---|---|---|---|---|---|
| Sample No. | Iron alloy powder | Hard phase forming alloy powder | Graphite powder | Copper powder | Valve sheet | Valve | Total | Notes |
| E04 | Balance | 35.00 | 1.00 | 0.00 | 27 | 4 | 31 | Practical example |
| E44 | Balance | 35.00 | 1.00 | 0.10 | 25 | 4 | 29 | Practical example |
| E45 | Balance | 35.00 | 1.00 | 1.00 | 23 | 5 | 28 | Practical example |
| E46 | Balance | 35.00 | 1.00 | 2.00 | 22 | 5 | 27 | Practical example |
| E47 | Balance | 35.00 | 1.00 | 3.00 | 22 | 5 | 27 | Practical example |
| E48 | Balance | 35.00 | 1.00 | 4.00 | 23 | 6 | 29 | Practical example |
| E49 | Balance | 35.00 | 1.00 | 5.00 | 24 | 7 | 31 | Practical example |
| E50 | Balance | 35.00 | 1.00 | 7.00 | 53 | 46 | 99 | Comparative example |

According to Table E-8, compared with the sample No. E04 in which the copper powder was not added to the raw powder and Cu was not added in the matrix, in the samples Nos. E44 to E49 in which the copper powder was added at not more than 5%, the wear amount of the valve sheet was decreased and the total of the wear amounts was decreased. In the sample No. E50 in which the amount of the copper powder was greater than 5%, a part of Cu was not solid-solved in the matrix, and Cu phase was dispersed in the matrix, whereby the strength of the matrix was decreased, and the wear amount of the valve sheet was increased. Moreover, the amount of hard martensite was increased, and the erosion of valve (the mating material) was increased, whereby the wear amount of the valve was increased and the total of the wear amounts was remarkably increased. Accordingly, although wear resistance was improved by adding the copper powder, the amount of the copper powder should be not more than 5.0%.

Example F

Fe—Mo—C Alloy Matrix

Example F-1

An iron alloy powder consisting of 3% of Mo and the balance of Fe and inevitable impurities, a hard phase forming alloy powder shown in Table F-1, and a graphite powder were prepared. The iron alloy powder, 35% of the hard phase forming alloy powder, and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. F01 to F06 were formed. The simple wear tests and the corrosion tests were performed in the same way as in the example C-1 for these samples. The results of these tests are also shown in Table F-1.

TABLE F-1

| Sample No. | Mixing ratio mass % | | | | | | | | Evaluation item | | | | |
|---|---|---|---|---|---|---|---|---|---|---|---|---|---|
| | Iron alloy powder | Hard phase forming alloy powder | Compositions mass % | | | | | Graphite powder | Wear amount μm | | | Corrosion loss mg/cm$^2$ | Notes |
| | | | Co | Fe | Cr | Mo | Si | | Valve sheet | Valve | Total | | |
| F01 | Balance | 35.00 | Balance | 42.00 | 5.00 | 20.00 | 3.00 | 1.00 | 63 | 5 | 68 | 0.28 | Comparative example |
| F02 | Balance | 35.00 | Balance | 37.00 | 10.00 | 20.00 | 3.00 | 1.00 | 37 | 5 | 42 | 0.14 | Practical example |
| F03 | Balance | 35.00 | Balance | 27.00 | 20.00 | 20.00 | 3.00 | 1.00 | 25 | 5 | 30 | 0.11 | Practical example |
| F04 | Balance | 35.00 | Balance | 17.00 | 30.00 | 20.00 | 3.00 | 1.00 | 18 | 5 | 23 | 0.08 | Practical example |
| F05 | Balance | 35.00 | Balance | 7.00 | 40.00 | 20.00 | 3.00 | 1.00 | 28 | 7 | 35 | 0.14 | Practical example |
| F06 | Balance | 35.00 | Balance | 2.00 | 45.00 | 20.00 | 3.00 | 1.00 | 55 | 26 | 81 | 0.20 | Comparative example |

According to Table F-1, the influence of the amount of Cr in the hard phase forming alloy powder (the amount of Cr in the hard phase) was investigated. In the sample No. F01, the amount of Cr in the hard phase forming alloy powder was insufficient, whereby the matrix of sintered alloy was not sufficiently strengthened, and the wear amount of the valve sheet was large. Moreover, the amount of Cr was insufficient, whereby corrosion resistance was insufficient, and the corrosion loss was also large. In the sample No. F02 in which the amount of Cr in the hard phase forming alloy powder was 10%, the wear amount of the valve sheet was remarkably decreased because the matrix was strengthened by Cr. Moreover, the corrosion loss was reduced because corrosion resistance was improved by Cr. When the amount of Cr in the hard phase forming alloy powder was not more than 30%, the wear amounts of the valve sheets were at low levels and the corrosion losses were reduced according to the increase in the amount of Cr. In the sample No. F05 in which the amount of Cr in the hard phase forming alloy powder was 40%, the hardness of the hard phase forming alloy powder was increased by the increase in the amount of Cr in the hard phase forming alloy powder, whereby compressibility of the raw powder was decreased, and the density of the green compact was decreased. As a result, the density of the sintered compact was decreased, whereby the wear amount of the valve sheet and the corrosion loss was increased, but these values were sufficiently small. Moreover, the wear particles of the valve sheet eroded the valve, and the wear amount of the valve was also increased, but this value was small. However, in the sample No. F06 in which the amount of Cr in the hard phase forming alloy powder was greater than 40%, this tendency was more remarkable, and therefore the total of the wear amounts and the corrosion loss were remarkably increased. According to the above results, when the amount of Cr in the hard phase forming alloy powder was 10 to 40%, the wear amounts of the valve sheet and the valve were small and the corrosion losses of the sintered alloys were small.

Example F-2

The iron alloy powder (Fe-3% Mo powder) used in the example F-1 the hard phase forming alloy powder (Co-30% Cr-20% Mo-17% Fe-3% Si powder) used in the sample No. F04 in the example F-1, and a graphite powder were prepared. The ratio of the hard phase forming alloy powder was changed as shown in Table F-2, and these powders were added and mixed. Furthermore, 0.8 mass parts of zinc stearate as a forming lubricant was added and mixed with 100 mass parts of the mixed powder, and a raw powder was obtained. The obtained raw powder as compacted and sintered in the same way as in the example A-1, and samples Nos. F07 to F11 were formed. The wear tests and the corrosion tests were performed in the same way as in the example C-1 for these samples. The results are shown in Table F-2 with the values of the sample No. F04 in the example F-1.

TABLE F-2

| Sample No. | Mixing ratio mass % | | | Evaluation item | | | | |
|---|---|---|---|---|---|---|---|---|
| | Iron alloy powder | Hard phase forming alloy powder | Graphite powder | Wear amount μm | | | Corrosion loss mg/cm$^2$ | Notes |
| | | | | Valve sheet | Valve | Total | | |
| F07 | Balance | 5.00 | 1.00 | 72 | 2 | 74 | 0.46 | Comparative example |
| F08 | Balance | 15.00 | 1.00 | 35 | 4 | 39 | 0.18 | Practical example |
| F09 | Balance | 25.00 | 1.00 | 21 | 5 | 26 | 0.13 | Practical example |
| F04 | Balance | 35.00 | 1.00 | 18 | 5 | 23 | 0.08 | Practical example |

TABLE F-2-continued

| Sample No. | Mixing ratio mass % Iron alloy powder | Hard phase forming alloy powder | Graphite powder | Evaluation item Wear amount μm Valve sheet | Valve | Total | Corrosion loss mg/cm$^2$ | Notes |
|---|---|---|---|---|---|---|---|---|
| F10 | Balance | 45.00 | 1.00 | 29 | 7 | 36 | 0.15 | Practical example |
| F11 | Balance | 55.00 | 1.00 | 54 | 40 | 94 | 0.26 | Comparative example |

According to Table F-2, the influence of the amount of the hard phase forming alloy powder (the amount of the hard phase dispersed in the matrix) was investigated. In the sample No. F07 in which the amount of the hard phase forming alloy powder was less than 15%, the wear amount of the valve sheet was large because the amount of the hard phase was insufficient and the plastic flow of the matrix could not be prevented. Moreover, the hard phase was insufficient, and Cr was not sufficiently dispersed from the hard phase to the matrix, whereby the corrosion loss was large. In the sample No. F08 in which the amount of the hard phase forming alloy powder was 15%, the wear amount of the valve sheet was remarkably decreased and the corrosion loss was decreased because the wear resistance and corrosion resistance of the matrix of the sintered alloy were improved by the hard phase. When the amount of the hard phase forming alloy powder was not more than 35%, the wear amount of the valve sheet and the corrosion loss were decreased according to the increase in the amount of the hard phase forming alloy powder. In the sample No. F10 in which the amount of the hard phase forming alloy powder was 45%, compressibility of the raw powder was decreased by the increase in the amount of the hard phase forming alloy powder, whereby the wear amount of the valve sheet and the corrosion loss were slightly increased, but these were at low levels. On the other hand, in the sample No. F11 in which the amount of the hard phase forming alloy powder was greater than 45%, the influence of the decrease of compressibility was remarkable, whereby the wear amount of the valve sheet was remarkably increased and the corrosion loss was increased. Moreover, the wear amount of the valve was also remarkably increased because the wear particles of the valve sheet eroded the valve. According to the above results, when the amount of the hard phase forming alloy powder (the amount of the hard phase dispersed in the matrix) was 15 to 45%, the wear amounts of the valve sheet and the valve were small.

Example F-3

An iron alloy powder as shown in Table F-3, a graphite powder, and the hard phase forming alloy powder (Co-30% Cr-20% Mo-17% Fe-3% Si powder) used in the sample No. F04 in the example F-1 were prepared. In the iron alloy powder, the amount of Mo was different from that of the iron alloy powder used in the example F-1. The iron alloy powder, 35% of the hard phase forming alloy powder, and 1% of the graphite powder were added and mixed. Furthermore, 0.8 mass parts of zinc stearate as a forming lubricant was added and mixed with 100 mass parts of the mixed powder, and a raw powder was mixed. The obtained raw powder was compacted and sintered in the same way as in the example A-1, and samples Nos. F12 to F16 were formed. The wear tests and the corrosion tests were performed in the same way as in the example C-1 for these samples. The results are shown in Table F-3 with the values of the sample No. F04 in the example F-1.

TABLE F-3

| Sample No. | Mixing ratio mass % Iron alloy powder compositions Fe | Mo | Hard phase forming alloy powder | Graphite powder | Evaluation item Wear amount μm Valve sheet | Valve | Total | Corrosion loss mg/cm$^2$ | Notes |
|---|---|---|---|---|---|---|---|---|---|
| F12 | Balance | 0.00 | 35.00 | 1.00 | 61 | 4 | 65 | 0.25 | Comparative example |
| F13 | Balance | 1.00 | 35.00 | 1.00 | 31 | 5 | 36 | 0.16 | Practical example |
| F04 | Balance | 3.00 | 35.00 | 1.00 | 18 | 5 | 23 | 0.08 | Practical example |
| F14 | Balance | 5.00 | 35.00 | 1.00 | 20 | 5 | 25 | 0.12 | Practical example |
| F15 | Balance | 7.00 | 35.00 | 1.00 | 34 | 6 | 40 | 0.15 | Practical example |
| F16 | Balance | 8.00 | 35.00 | 1.00 | 56 | 8 | 64 | 0.27 | Comparative example |

According to Table F-3, the influence of the amount of Mo in the iron alloy powder was investigated. In the sample No. F12 in which the amount of Mo was less than 1%, the wear amount of the valve sheet and the corrosion loss were large because Fe matrix was not strengthened by Mo. However, in the sample No. F13 in which the amount of Mo in the iron alloy powder was 1%, the wear amount of the valve sheet was remarkably decreased because the Fe matrix was strengthened by Mo, and the corrosion loss was decreased because the corrosion resistance of the Fe matrix was improved. When the amount of Mo in the iron alloy powder was not more than 3%, the wear amount of the valve sheet and the corrosion loss were decreased according to the increase in the amount of Mo in the iron alloy powder. In the samples Nos. F14 and F15 in which the amount of Mo in the iron alloy powder was 5 to 7%, compressibility of the raw powder was decreased by the increase in the hardness of the iron alloy powder, whereby the density of the green compact was decreased. As a result, the density of the sintered compact was decreased, whereby the wear amount of valve sheet and the corrosion loss were slightly increased, but these were low values. On the other hand, in the sample No. F16 in which the amount of Mo in the iron alloy powder was greater than 8%, the influence of the increase in the hardness of the iron alloy powder was remarkable, and the density of the sintered compact was remarkably decreased, whereby the wear amount of the valve sheet and the corrosion loss were remarkably increased. According to the above results, when the amount of Mo in the iron alloy powder was 1 to 7%, the wear amount of the valve sheet was small and the corrosion loss was reduced.

Example F-4

The iron alloy powder (Fe-3% Mo powder) used in the example F-1 the hard phase forming alloy powder (Co-30% Cr-20% Mo-17% Fe-3% Si powder) used in the sample No. F04 in the example F-1, and a graphite powder were prepared. The ratio of the graphite powder was changed as shown in Table F-4, and these powders were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. F17 to F22 were formed. The wear tests were performed in the same way as in the example C-1 for these samples. The results are shown in Table F-4 with the values of the sample No. F04 in the example F-1.

TABLE F-4

| Sample No. | Mixing ratio mass % Iron alloy powder | Hard phase forming alloy powder | Graphite powder | Evaluation item Wear amount μm Valve sheet | Valve | Total | Notes |
|---|---|---|---|---|---|---|---|
| F17 | Balance | 35.00 | 0.30 | 75 | 4 | 79 | Comparative example |
| F18 | Balance | 35.00 | 0.50 | 42 | 5 | 47 | Practical example |
| F19 | Balance | 35.00 | 0.80 | 21 | 5 | 26 | Practical example |
| F04 | Balance | 35.00 | 1.00 | 18 | 5 | 23 | Practical example |

TABLE F-4-continued

| Sample No. | Mixing ratio mass % Iron alloy powder | Hard phase forming alloy powder | Graphite powder | Evaluation item Wear amount μm Valve sheet | Valve | Total | Notes |
|---|---|---|---|---|---|---|---|
| F20 | Balance | 35.00 | 1.20 | 2 | 6 | 8 | Practical example |
| F21 | Balance | 35.00 | 1.50 | 41 | 10 | 51 | Practical example |
| F22 | Balance | 35.00 | 1.80 | 68 | 47 | 115 | Comparative example |

According to Table F-4, the influence of the amount of the graphite powder (the amount of C in the overall composition) was investigated. In the sample No. F17 in which the amount of the graphite powder was less than 0.5%, the wear amount of the valve sheet was large because Fe matrix of the sintered alloy was not sufficiently strengthened. In the sample No. F18 in which the amount of the graphite powder was 0.5%, the wear amount of the valve sheet was remarkably decreased because the Fe matrix of the sintered alloy was strengthened. When the amount of the graphite powder was not more than 1.0%, the wear amount of the valve sheet was decreased according to the increase in the amount of the graphite powder. In the sample in which the amount of the graphite powder was 1.2 to 1.5%, the wear amount of the valve sheet was increased and the wear amount of the valve was slightly increased because the Fe matrix of the sintered alloy was hardened and embrittled. In this case, the total of the wear amounts was not a problem in practical use. On the other hand, in the sample No. F22 in which the amount of the graphite powder was greater than 1.5%, this tendency was more remarkable, and therefore the wear amount of the valve sheet was remarkably increased. Moreover, the wear amount of the valve was also remarkably increased because the wear particles of the valve sheet eroded the valve. According to the above results, when the amount of the graphite powder (the amount of C in the overall composition) was 0.5 to 1.5%, the wear amounts of the valve sheet and the valve were small.

Example F-5

The iron alloy powder (Fe-3% Mo powder) used in the example F-1, a graphite powder, and a hard phase forming alloy powder as shown in Table F-5 were prepared. The hard phase forming alloy powder had a composition in which a ratio of Co and Fe was different from that of the hard phase forming alloy powder (Co-30% Cr-20% Mo-17% Fe-3% Si powder) used in the sample No. F04 in the example F-1. The iron alloy powder, 35% of the hard phase forming alloy powder, and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. F23 to F28 were formed. The wear tests were performed in the same way as in the example C-1 for these samples. The results are shown in Table F-5 with the values of the sample No. F04 in the example F-1.

TABLE F-5

| Sample No. | Mixing ratio mass % | | | | | | | | | Evaluation item | | | |
|---|---|---|---|---|---|---|---|---|---|---|---|---|---|
| | Iron alloy powder | Hard phase forming alloy powder | | | | | | Substitutional ratio of Fe | Graphite powder | Wear amount μm | | | Notes |
| | | | Compositions mass % | | | | | | | Valve sheet | Valve | Total | |
| | | | Co | Fe | Cr | Mo | Si | | | | | | |
| F23 | Balance | 35.00 | Balance | 0.00 | 30.00 | 20.00 | 3.00 | 0.00 | 1.00 | 14 | 5 | 19 | Practical example |
| F24 | Balance | 35.00 | Balance | 0.00 | 30.00 | 20.00 | 3.00 | 0.00 | 1.00 | 16 | 5 | 21 | Practical example |
| F04 | Balance | 35.00 | Balance | 0.00 | 30.00 | 20.00 | 3.00 | 0.00 | 1.00 | 18 | 5 | 23 | Practical example |
| F25 | Balance | 35.00 | Balance | 0.00 | 30.00 | 20.00 | 3.00 | 0.00 | 1.00 | 20 | 5 | 25 | Practical example |
| F26 | Balance | 35.00 | Balance | 0.00 | 30.00 | 20.00 | 3.00 | 0.00 | 1.00 | 34 | 6 | 40 | Practical example |
| F27 | Balance | 35.00 | Balance | 0.00 | 30.00 | 20.00 | 3.00 | 0.00 | 1.00 | 61 | 7 | 68 | Practical example |
| F28 | Balance | 35.00 | Balance | 0.00 | 30.00 | 20.00 | 3.00 | 0.00 | 1.00 | 87 | 16 | 103 | Comparative example |

According to Table F-5, when Co in the hard phase forming alloy powder was substituted by Fe, the influence of the substitutional ratio of Fe was investigated. In the sample No. F23 in which Co in the hard phase forming alloy powder was not substituted by Fe, the wear amounts were the lowest among the above examples F and wear resistance was good. When Co in the hard phase forming alloy powder was substituted by Fe and the substitutional ratio of Fe was increased, the wear amounts were increased. In this case, when the substitutional ratio of Fe was not more than 80% (samples Nos. F04, F24 to F26), the wear amounts were not a problem in practical use. In the samples Nos. F27 and F28 in which the substitutional ratio of Fe was more than 80%, the wear amounts were remarkably increased because the effect of Co was insufficient. According to the above results, although Co in the hard phase forming alloy powder could be substituted by Fe, the substitutional ratio of Fe should be not more than 80%. Furthermore, the substitutional ratio of Fe was preferably not more than 60%.

Example F-6

The iron alloy powder (Fe-3% Mo powder) used in the example F-1, a graphite powder, and a hard phase forming alloy powder as shown in Table F-6 were prepared. The hard phase forming alloy powder was formed by adding different amount of Mn in the hard phase forming alloy powder (Co-30% Cr-20% Mo-17% Fe-3% Si powder) used in the sample No. F04 in the example F-1. The iron alloy powder, 35% of the hard phase forming alloy powder, and 1% of the graphite powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. F29 to F32 were formed. The wear tests were performed in the same way as in the example C-1 for these samples. The results are shown in Table F-6 with the values of the sample No. F04 in the example F-1.

TABLE F-6

| Sample No. | Mixing ratio mass % | | | | | | | | | | Evaluation item | | | |
|---|---|---|---|---|---|---|---|---|---|---|---|---|---|---|
| | Iron alloy powder | Hard phase forming alloy powder | | | | | | | | Graphite powder | Wear amount μm | | | Notes |
| | | | Compositions mass % | | | | | | | | Valve sheet | Valve | Total | |
| | | | Co | Fe | Cr | Mo | Si | Mn | | | | | | |
| F04 | Balance | 35.00 | Balance | 17.00 | 30.00 | 20.00 | 3.00 | — | | 1.00 | 18 | 5 | 23 | Practical example |
| F29 | Balance | 35.00 | Balance | 17.00 | 30.00 | 20.00 | 3.00 | 1.00 | | 1.00 | 16 | 5 | 21 | Practical example |
| F30 | Balance | 35.00 | Balance | 17.00 | 30.00 | 20.00 | 3.00 | 3.00 | | 1.00 | 14 | 7 | 21 | Practical example |
| F31 | Balance | 35.00 | Balance | 17.00 | 30.00 | 20.00 | 3.00 | 5.00 | | 1.00 | 17 | 13 | 30 | Practical example |
| F32 | Balance | 35.00 | Balance | 17.00 | 30.00 | 20.00 | 3.00 | 7.00 | | 1.00 | 33 | 51 | 84 | Comparative example |

According to Table F-6, the effect of Mn in the hard phase forming alloy powder (the hard phase) was investigated. In the samples Nos. F29 to F31 in which the amount of Mn in the hard phase forming alloy powder was not more than 5%, the alloy matrix of the hard phase was strengthened by Mn, whereby the wear amounts of the valve sheets were less than that of the sample No. F04 in which Mn was not added in the hard phase forming alloy powder. On the other hand, the wear amounts of the valves were slightly increased according to the increase in the amount of Mn, because the hard phase was strengthened. In the sample No. F32 in which the amount of Mn in the hard phase forming alloy powder was greater than 5%, the hard phase forming alloy powder was hardened, and compressibility of the raw powder was remarkably decreased, whereby the wear amount of the valve sheet was remarkably increased. Moreover, the wear amount of the valve was also remarkably increased because the wear particles of the valve sheet eroded the valve. According to the above results, although wear resistance could be further improved by adding Mn in the hard phase forming alloy powder, the amount of Mn in the hard phase forming alloy powder should not more than be 5%.

Example F-7

The iron alloy powder (Fe-3% Mo powder) used in the example F-1 the hard phase forming alloy powder (Co-30% Cr-20% Mo-17% Fe-3% Si powder) used in the sample No. F04 in the example F-1, a graphite powder, and a nickel powder were prepared. The iron alloy powder, 35% of the hard phase forming alloy powder, 1% of the graphite powder, and a ratio shown in Table F-7 of the nickel powder were added and mixed. Furthermore, 0.8 mass parts of zinc stearate as a forming lubricant was added and mixed with 100 mass parts of the mixed powder, and a raw powder was obtained. The obtained raw powder was compacted and sintered in the same way as in the example A-1, and samples Nos. F33 to F38 were formed. The wear tests were performed in the same way as in the example C-1 for these samples. The results are shown in Table F-7 with the values of the sample No. F04 in the example F-1.

TABLE F-7

| | Mixing ratio mass % | | | | Evaluation item | | | |
|---|---|---|---|---|---|---|---|---|
| | | | | | Wear amount μm | | | |
| Sample No. | Iron alloy powder | Hard phase forming alloy powder | Graphite powder | Nickel powder | Valve sheet | Valve | Total | Notes |
| F04 | Balance | 35.00 | 1.00 | 0.00 | 18 | 5 | 23 | Practical example |
| F33 | Balance | 35.00 | 1.00 | 1.00 | 15 | 5 | 20 | Practical example |
| F34 | Balance | 35.00 | 1.00 | 2.00 | 14 | 5 | 19 | Practical example |
| F35 | Balance | 35.00 | 1.00 | 3.00 | 14 | 5 | 19 | Practical example |
| F36 | Balance | 35.00 | 1.00 | 4.00 | 16 | 6 | 22 | Practical example |
| F37 | Balance | 35.00 | 1.00 | 5.00 | 18 | 7 | 25 | Practical example |
| F38 | Balance | 35.00 | 1.00 | 7.00 | 40 | 10 | 50 | Comparative example |

According to Table F-7, compared with the sample No. F04 in which the nickel powder was not added to the raw powder and Ni was not added in the matrix, in the samples Nos. F33 to F37 in which the nickel powder was added at not more than 5%, the wear amount of the valve sheet was decreased and the total of the wear amounts was decreased. In the sample No. F38 in which the amount of the nickel powder was greater than 5%, a large amount of Ni-rich austenite having low wear resistance was formed and remained in the matrix, whereby wear resistance of the valve sheet was decreased and the wear amount of the valve sheet was increased. Moreover, the amount of hard martensite was increased, and the erosion of the valve (the mating material) was increased, whereby the wear amount of the valve was increased and the total of the wear amounts was remarkably increased. Accordingly, although wear resistance was improved by adding the nickel powder, the amount of the nickel powder should be not more than 5.0%.

What is claimed is:

1. A wear resistant sintered alloy exhibiting a metallic structure in which 15 to 45 mass % of a hard phase is dispersed in a matrix, the hard phase consisting of, by mass %, 15 to 35% of Mo, 1 to 10% of Si, 10 to 40% of Cr, 7 to 37.6% of Fe, not more than 5% of Mn as an optional element, and the balance of Co and inevitable impurities.

2. The wear resistant sintered alloy according to claim 1, wherein the wear resistant sintered alloy has an overall composition consisting of, by mass %, 1 to 5% of Ni, 2.25 to 33.3% of Co, 1.5 to 18% of Cr, 2.25 to 15.75% of Mo, 0.15 to 4.5% of Si, 0.5 to 1.5% of C, and the balance of Fe and inevitable impurities, and the matrix is made of an Fe—Ni—C alloy.

3. The wear resistant sintered alloy according to claim 2, wherein the matrix of the Fe—Ni—C alloy includes at least one kind of an oxide of a metal at 0.15 to 1.25 mass % with respect to the overall composition, and the metal is selected from the group consisting of aluminum, silicon, magnesium, iron, titanium, and calcium.

4. The wear resistant sintered alloy according to claim 1, wherein the wear resistant sintered alloy has an overall composition consisting of, by mass %, 2.34 to 20.73% of Cr, 2.25 to 15.75% of Mo, 0.15 to 4.5% of Si, 2.25 to 33.3% of Co, 0.5 to 1.5% of C, not more than 2% of at least one of V and Nb as optional elements, not more than 5% of Ni as an optional element, not more than 2% of Mo as optionally added amount, and the balance of Fe and inevitable impurities, and the matrix is made of an Fe—Cr—C alloy.

5. The wear resistant sintered alloy according to claim 1, wherein the wear resistant sintered alloy has an overall composition consisting of, by mass %, 1.5 to 18% of Cr, 0.54 to 1.69% of Ni, 3.09 to 16.84% of Mo, 0.15 to 4.5% of Si, 4.76 to 37.66% of Co, 0.5 to 1.5% of C, not more than 5% of Ni as optionally added amount, and the balance of Fe and inevitable impurities, and the matrix is made of an Fe—Co—C alloy.

6. The wear resistant sintered alloy according to claim 1, wherein the wear resistant sintered alloy has an overall composition consisting of, by mass %, 1.58 to 18.55% of Cr, 0.54 to 2.54% of Ni, 2.67 to 16.84% of Mo, 0.15 to 4.5% of Si, 2.25 to 33.30% of Co, 0.05 to 0.42% of Mn, 0.5 to 1.5% of C, not more than 5% of Ni as optionally added amount and/or cu as an optional element, and the balance of Fe and inevitable impurities, and the matrix is made of an Fe—Ni—Mo—C alloy.

7. The wear resistant sintered alloy according to claim 1, wherein the wear resistant sintered alloy has an overall composition consisting of, by mass %, 1.5 to 18% of Cr, 3.09 to 19.57% of Mo, 0.15 to 4.5% of Si, 2.25 to 33.3% of Co, 0.5 to 1.5% of C, not more than 5% of Ni as an optional element, and the balance of Fe and inevitable impurities, and the matrix is made of an Fe—Mo—C alloy.

8. The wear resistant sintered alloy according to claim 1, wherein the sintered alloy has pores and grain boundaries, at least one kind of powder of machinability improving material is dispersed in the pores and the grain boundaries at 0.3 to 2 mass %, and the machinability improving material is selected from the group consisting of lead, disulfide molybdenum, manganese sulfide, boron nitride, calcium metasilicate mineral, and calcium fluoride.

9. The wear resistant sintered alloy according to claim 1, wherein the sintered alloy has pores filled with one kind selected from the group consisting of lead, lead alloy, copper, copper alloy, and acrylic resin.

* * * * *